US010828234B2

(12) United States Patent
Laemmle et al.

(10) Patent No.: US 10,828,234 B2
(45) Date of Patent: Nov. 10, 2020

(54) METHOD FOR PRODUCING BLISTER PACKS FOR MEDICINAL PRODUCTS AND BLISTER PACK

(71) Applicant: Uhlmann Pac-Systeme GmbH & Co. KG, Laupheim (DE)

(72) Inventors: Kurt Laemmle, Ehingen (DE); Christian Link, Baustetten (DE); Peter Rafensteiner, Laupheim (DE); Martin Seiffert, Schelklingen (DE); Michael Schultes, Ehingen (DE)

(73) Assignee: Uhlmann Pac-Systeme GmbH & Co. KG, Laupheim (DE)

( * ) Notice: Subject to any disclaimer, the term of this patent is extended or adjusted under 35 U.S.C. 154(b) by 0 days.

(21) Appl. No.: 16/521,892

(22) Filed: Jul. 25, 2019

(65) Prior Publication Data

US 2020/0030186 A1 Jan. 30, 2020

(30) Foreign Application Priority Data

Jul. 26, 2018 (EP) ..... 18185826

(51) Int. Cl.
*A61J 1/03* (2006.01)
*B65B 47/00* (2006.01)
(Continued)

(52) U.S. Cl.
CPC ..... *A61J 1/035* (2013.01); *B65B 5/02* (2013.01); *B65B 5/04* (2013.01); *B65B 7/164* (2013.01); *B65B 41/12* (2013.01); *B65B 47/00* (2013.01)

(58) Field of Classification Search
CPC .. B65B 5/02; B65B 5/04; B65B 7/164; B65B 47/00; A61J 1/035
(Continued)

(56) References Cited

U.S. PATENT DOCUMENTS 3,343,897 A * 9/1967 Keller ..... B65D 75/367 312/31
5,698,217 A * 12/1997 Wilking ..... A61K 9/703 424/448
(Continued)

FOREIGN PATENT DOCUMENTS

WO WO 96/07601 A1 3/1996
WO WO 2011/052422 A1 5/2011

OTHER PUBLICATIONS

International Search Report dated Sep. 26, 2018.

*Primary Examiner* — Robert F Long
*Assistant Examiner* — Xavier A Madison
(74) *Attorney, Agent, or Firm* — Dickinson Wright PLLC

(57) ABSTRACT

The method for producing blister packs for medicinal products comprises the steps of forming blister pockets in a bottom film, wherein each blister pocket has an at least two-level shape with a first recess and a second, lower recess, filling the second recesses of the blister pockets with the medicinal products, placing a strip of active material in the first recess of each blister pocket above the medicinal product, wherein the strip of active material rests on at least one support surface of the first recess next to the second recess, sealing a lidding film to webs of the bottom film arranged around the blister pockets and simultaneously to the strips of active material, thus forming a sealed blister web, and stamping out individual blister packs from the blister web.

8 Claims, 35 Drawing Sheets

(51) Int. Cl.

| | |
|---|---|
| ***B65B 5/02*** | (2006.01) |
| ***B65B 41/12*** | (2006.01) |
| ***B65B 5/04*** | (2006.01) |
| ***B65B 7/16*** | (2006.01) |

(58) Field of Classification Search
USPC ..... 53/453
See application file for complete search history.

(56) References Cited

U.S. PATENT DOCUMENTS

| | | | | |
|---|---|---|---|---|
| 6,010,715 | A * | 1/2000 | Wick | A61K 9/7084 424/448 |
| 6,622,864 | B1 * | 9/2003 | Debbs | A61L 2/26 206/363 |
| 6,821,594 | B2 * | 11/2004 | Watanabe | B32B 27/06 206/204 |
| 8,142,603 | B2 * | 3/2012 | Sagona | B65D 81/267 156/308.4 |
| 2011/0244085 | A1 * | 10/2011 | Crump | B65D 81/268 426/118 |
| 2011/0266189 | A1 | 11/2011 | Tom et al. | |
| 2013/0217142 | A1 | 8/2013 | Farge et al. | |
| 2018/0110579 | A1 * | 4/2018 | Kalyankar | B65D 65/12 |
| 2020/0016034 | A1 * | 1/2020 | Voellmicke | A61J 1/035 |

* cited by examiner

METHOD FOR PRODUCING BLISTER PACKS FOR MEDICINAL PRODUCTS AND BLISTER PACK

RELATED APPLICATIONS

This application claims priority to European Patent Application No. 18 185 826.7, filed on Jul. 26, 2018, entitled "Method for Producing Blister Packs for Medicinal Products and Blister Pack", the contents of which are incorporated herein by reference in their entirety.

FIELD

The disclosure relates to a method for producing blister packs for medicinal products, especially tablets, capsules, or sugar-coated pills, and to a corresponding blister pack.

BACKGROUND

Blister packs for medicinal products are usually produced by first forming a plurality of blister pockets in a bottom film and then filling them with the medicinal products. After that, a lidding film is sealed onto the bottom film, so that a sealed blister web is formed, and finally the individual blister packs are stamped out of the blister web.

For certain medicinal products, it can also be necessary to provide an insert of active material in the area of the blister pocket; this material can serve, for example, to dry the air present in the sealed pocket and thus to ensure the integrity of the medicinal product. Inserts of active material are usually placed in a chamber connected to the blister pocket before the pocket is sealed with the lidding film.

Because of the additional inserts of active material, however, blister packs produced by the known methods require a larger amount of space. In addition, the inserts of active material must be introduced into relatively complex chambers in the blister pockets, so that the inserts will not fall out of the blister pocket when the blister pocket is squeezed by the user, who might then unintentionally ingest the insert. This complicates the production process.

BRIEF SUMMARY

It is therefore an object of the present disclosure to provide a method which is as simple as possible for the production of blister packs for medicinal products with an active material in the area of the pockets of the blister pack, so that the blister packs take up only a small amount of space and can be handled safely, and to provide a corresponding blister pack.

According to an aspect of the disclosure, the method for producing blister packs for medicinal products, especially tablets, capsules, or sugar-coated pills, comprises the steps of:

providing a bottom film and forming a plurality of blister pockets in the bottom film, wherein each blister pocket has an at least two-level shape with a first recess, which defines a first level of the blister pocket, and a second recess, which is arranged in a subsection of the two-dimensional area over which the first recess extends and is situated lower down than the first recess;

filling the second recesses of the blister pockets with the medicinal products;

providing strips of active material and placing a strip of active material in the first recess of each blister pocket above the medicinal product, wherein the strip of active material rests on at least one, preferably on at least two, support surfaces of the first recess next to the second recess;

providing a lidding film and sealing the lidding film to webs of the bottom film arranged around the blister pockets and simultaneously to the strips of active material, thus forming a sealed blister web; and stamping out individual blister packs from the blister web.

Because the lidding film is sealed simultaneously to the webs of the bottom film and to the strips of active material, it is easy to produce blister packs which take up a relatively small amount of space and which ensure that, when the medicinal products are squeezed out, the active material remains adherent to the lidding film.

The step of providing the strips of active material is preferably accomplished by providing a web of active material wound up into a roll and by stamping out the strips of active material from the unwound web. This makes it possible to provide large numbers of strips of active material.

The strips of active material are preferably sections of a film. As a result, the strips of active material are very easily sealed to the lidding film and take up only a small amount of space in the height direction.

It is especially preferred that the strips of active material have a thickness in the range of 0.2-2 mm, more preferably of 0.3-1.2 mm. Strips of active material of this thickness can be handled reliably, and the amount of space they occupy is reduced.

As a result of its material properties, the active material preferably comprises an absorption function for absorbing at least one substance or a release function for releasing at least one substance. As a result, depending on the requirements, the integrity of the medicinal products in the pockets can be ensured even over a relatively long period of time.

It is preferred that the placing of the strips of active material be performed by a pick-and-place device. As a result, the required precision with which the strips of active material are placed is guaranteed, and a high throughput is obtained.

After the strips of active material have been placed on the support surface(s) of the first recess, the strips of active material preferably extend above the webs of the bottom film by an amount in the range of 0.05-0.5 mm, more preferably of 0.08-0.2 mm. This ensures that, during the following step of sealing the lidding film, the lidding film will also be sealed to the strips of active material, whereas, because the amount by which the strips of active material project above the webs of the bottom film is so small, and because the strips of active material are compressible, the lidding film can also be sealed simultaneously to the webs of the bottom film in a single operation.

In a preferred embodiment, during the forming of the plurality of blister pockets in the bottom film, an upward-projecting rib extending around each second recess is formed, or at least two upward-projecting knobs spaced a certain distance apart are formed, in a bottom area of each first recess to serve as the support surface or support surfaces for the strip of active material in question. In this way, a gap is created between the medicinal products and the strips of active material, and in addition, as a result of the counter-pressure of the rib or of the at least two upward-projecting knobs, the quality of the seal between the lidding film and the strips of active material at these points is increased.

The blister pack produced according to the disclosure for medicinal products, especially tablets, capsules, or sugar-coated pills, comprises a bottom film, in which at least one blister pocket is formed, which is surrounded by webs of the bottom film, wherein the at least one blister pocket comprises an at least two-level shape with a first recess, which defines a first level of the blister pocket, and a second recess, which is formed in a subsection of the two-dimensional area over which the first recess extends and is situated lower down than the first recess. The blister pack also comprises a lidding film, which covers the at least one blister pocket and is sealed to the webs of the bottom film, and a strip of active material, which is arranged in the at least one blister pocket and is sealed to the lidding film. The medicinal product is accommodated in the second recess, and the strip of active material is accommodated in the first recess, wherein the strip of active material rests on at least one, preferably at least two, support surfaces in a bottom area of the first recess, which support surface is, or which support surfaces are, arranged next to the second recess.

With this configuration, it is guaranteed that the active material and the medicinal products are separated from each other in each pocket and simultaneously that the active material remains adherent to the lidding film when the medicinal product is squeezed out. With this arrangement, furthermore, the amount of space each blister pocket occupies is also minimized.

DETAILED DESCRIPTION

Figure 1:
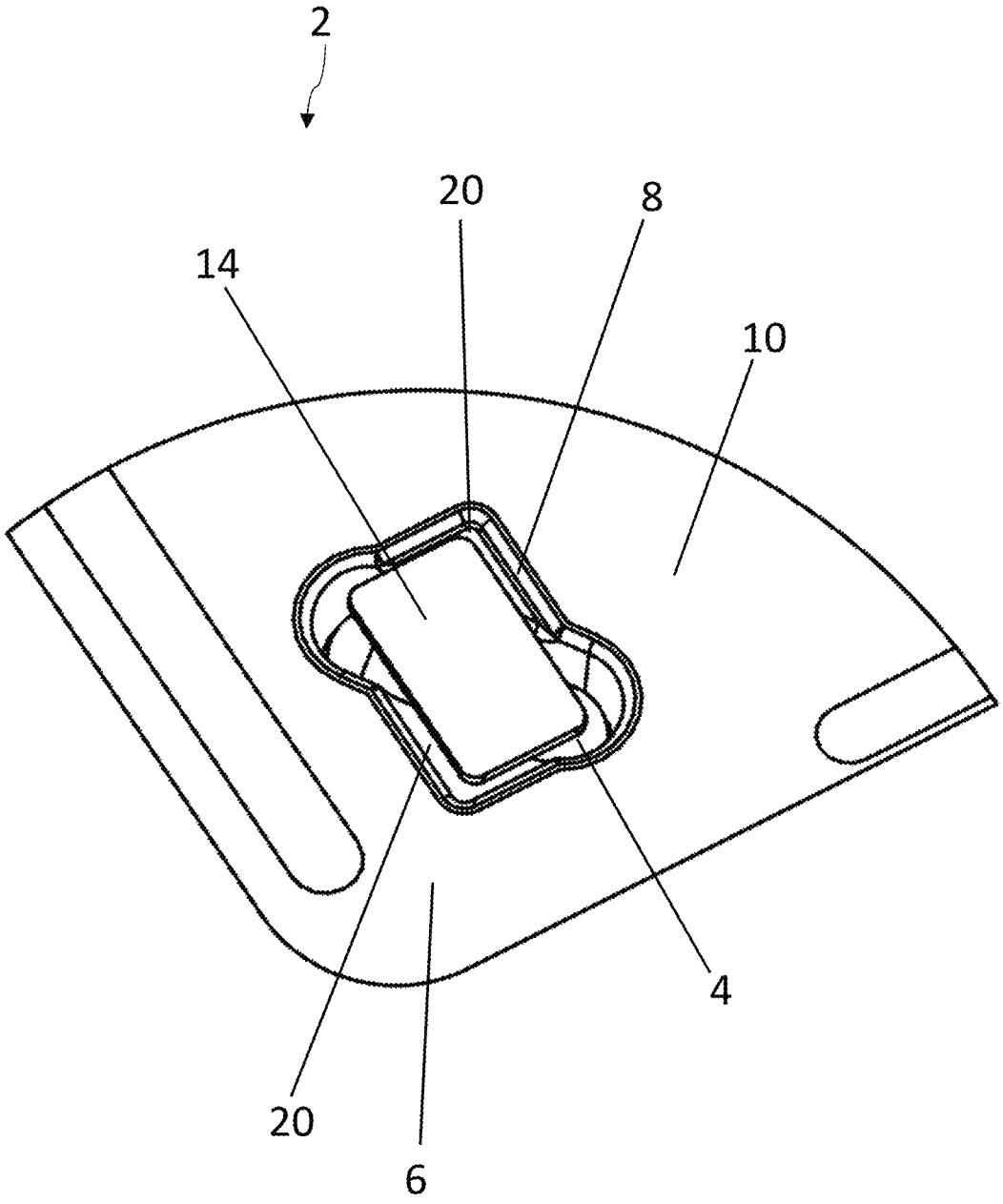
FIG. 1 is a perspective view of part of one embodiment of a blister pack according to the disclosure, in which the lidding film has been omitted for the sake of clarity.
Figure 2:
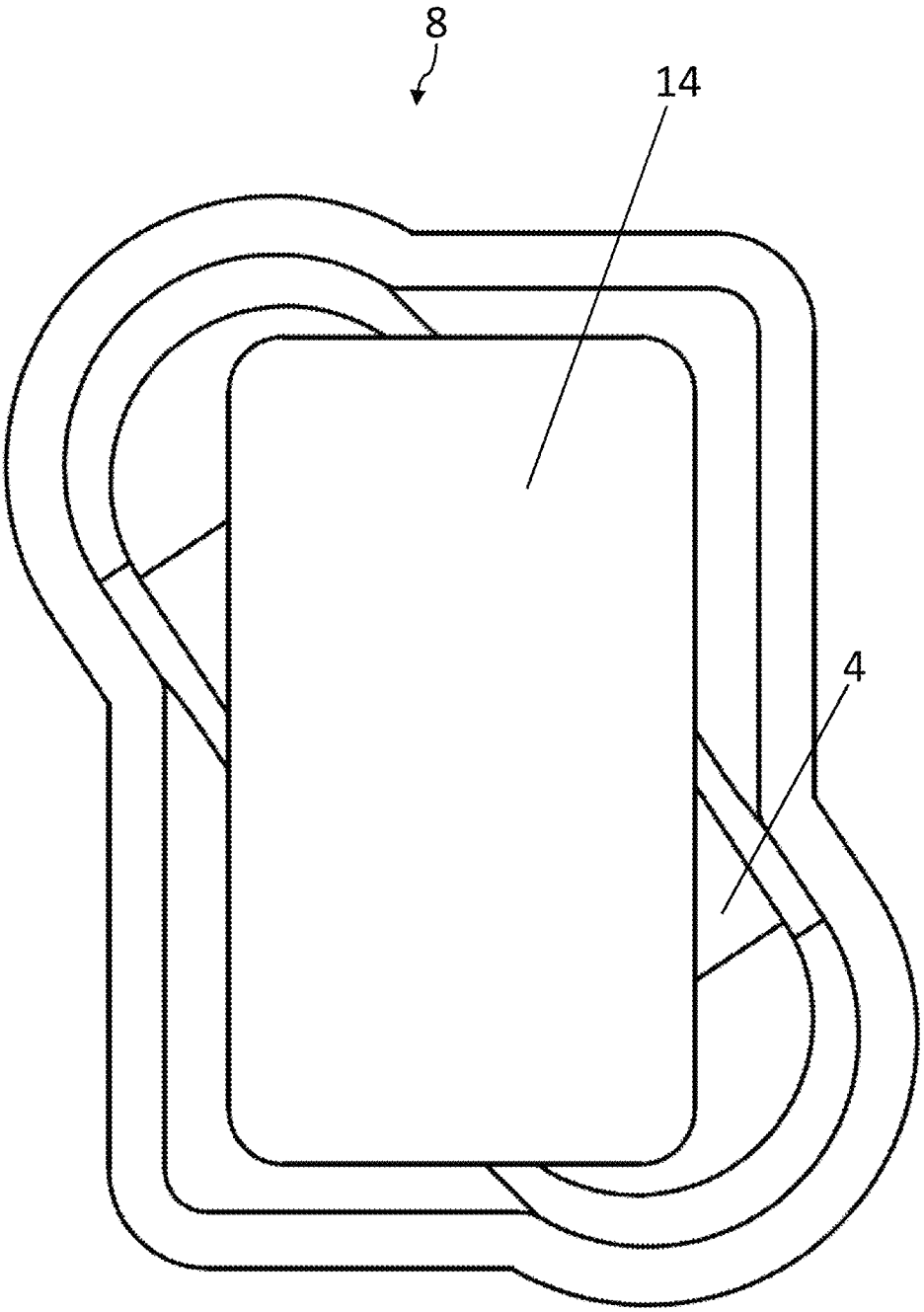
FIG. 2 is a top view of a blister pocket of the blister pack of FIG. 1, wherein the lidding film has been omitted for the sake of clarity.
Figure 3:
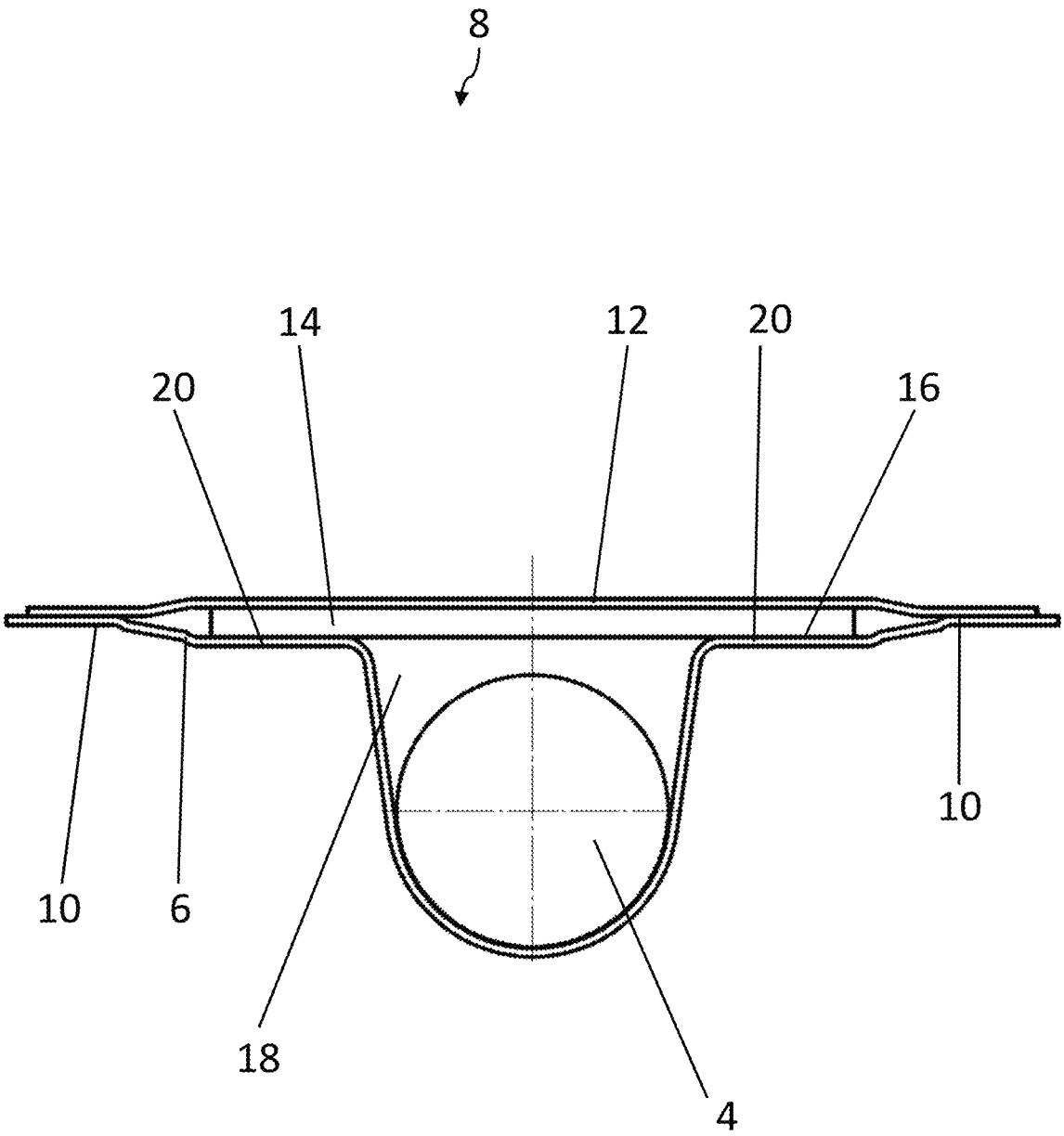
FIG. 3 is a cross-sectional view of a blister pocket of the blister pack of FIG. 1.
Figure 4:
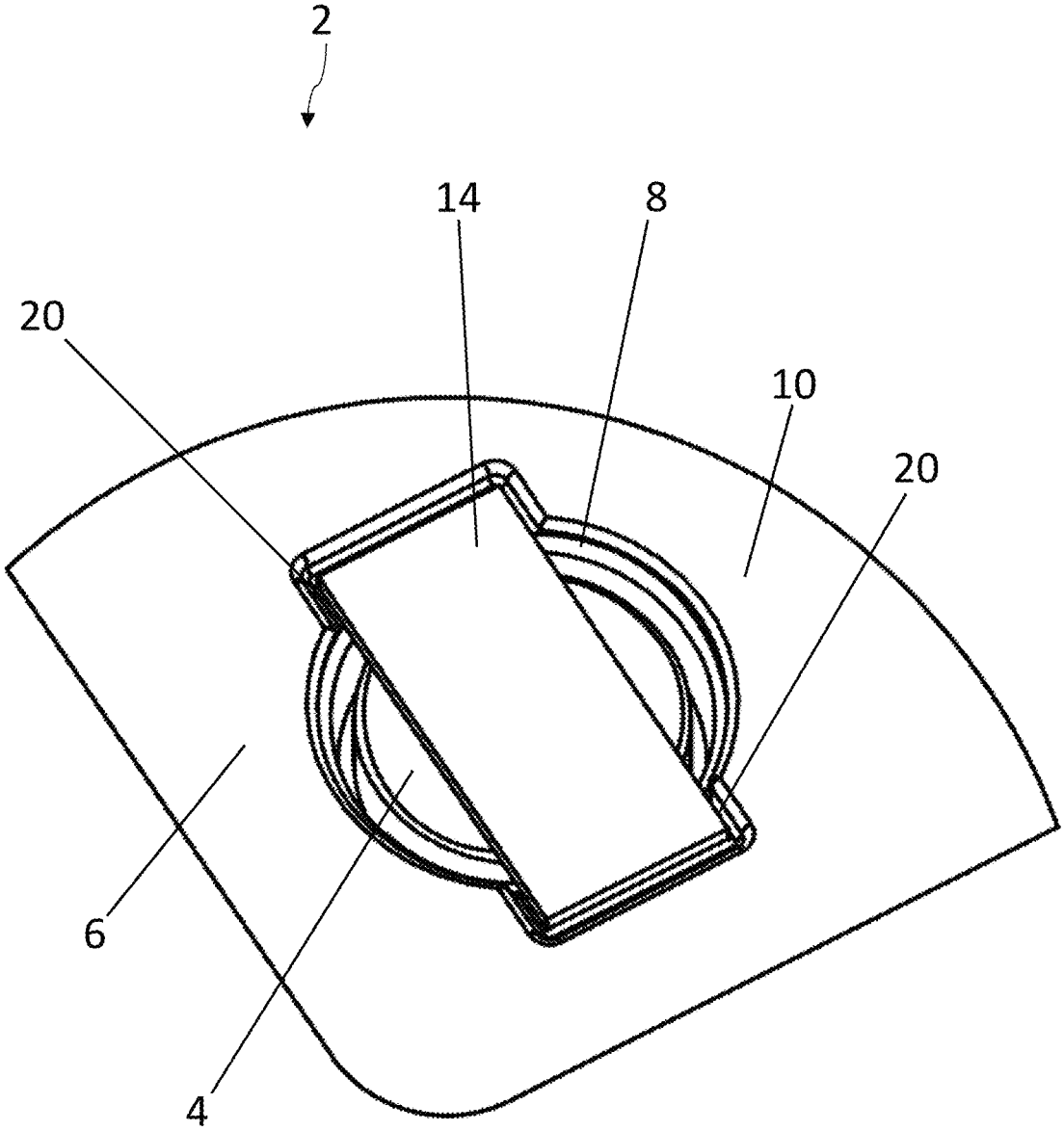
FIG. 4 is a perspective view of part of another embodiment of a blister pack according to the disclosure, in which the lidding film has been omitted for the sake of clarity.
Figure 5:
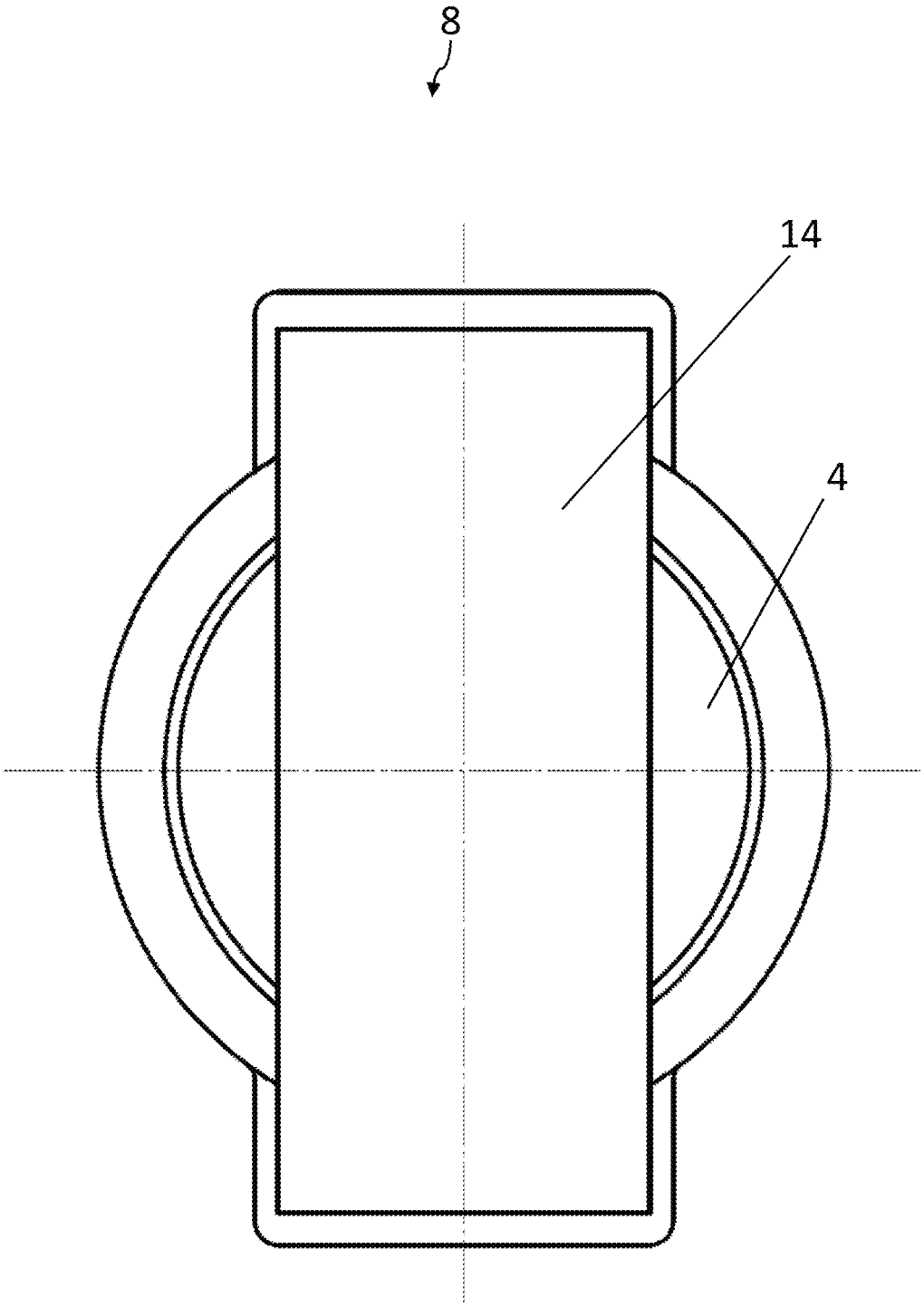
FIG. 5 is a top view of a blister pocket of the blister pack of FIG. 4, wherein the lidding film has been omitted for the sake of clarity.
Figure 6:
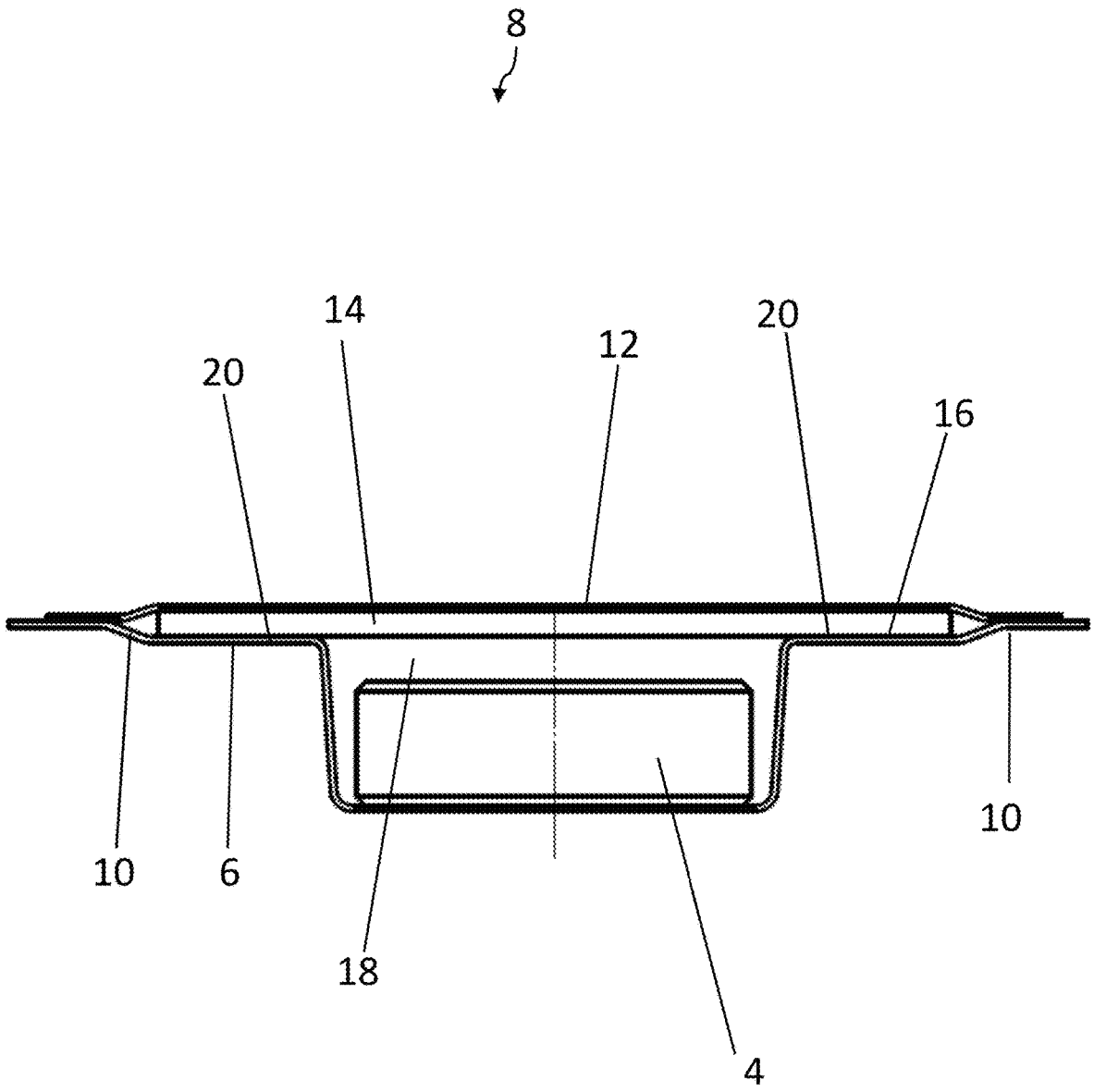
FIG. 6 is a cross-sectional view of a blister pocket of the blister pack of FIG. 4 with a sealed-on lidding film in a first cross-sectional direction.
Figure 7:
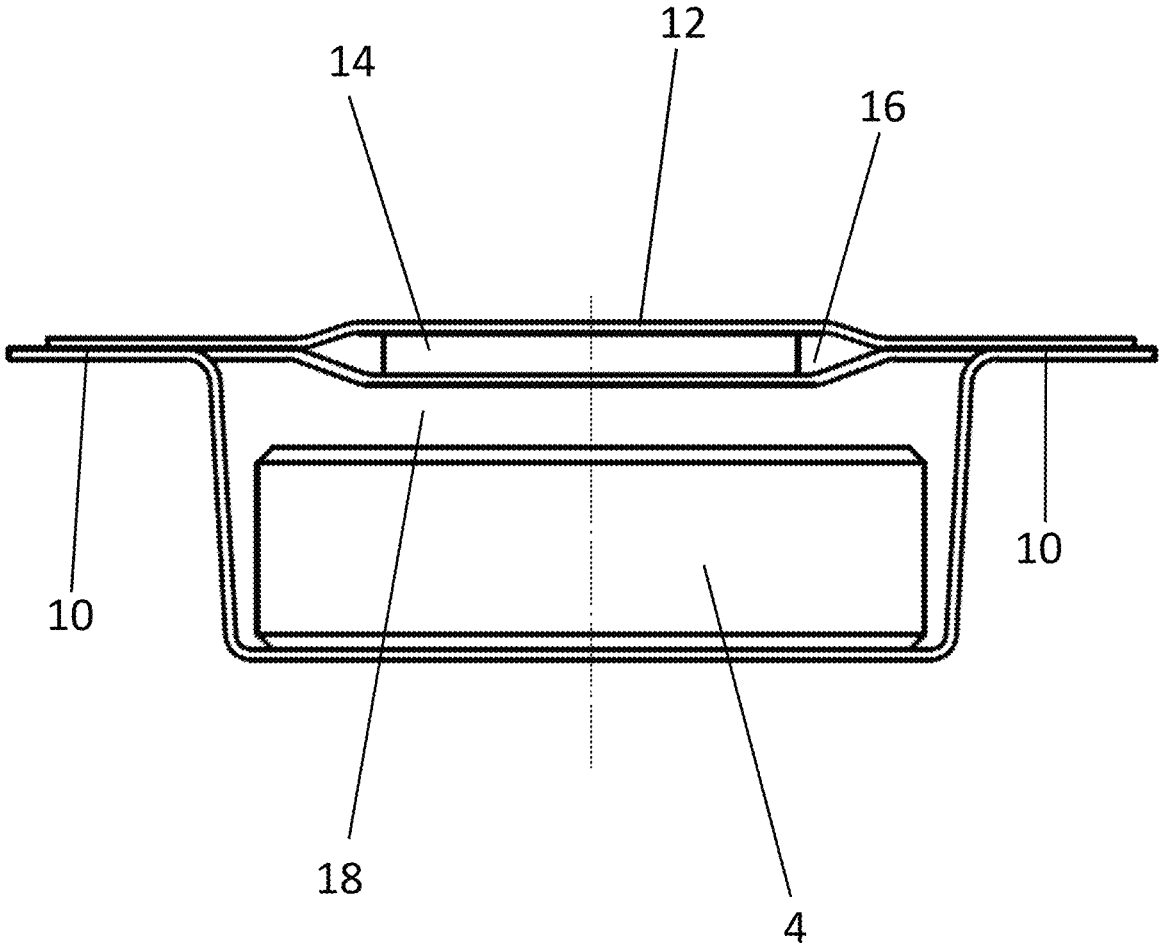
FIG. 7 is a cross-sectional view of a blister pocket of the blister pack of FIG. 4 with a sealed-on lidding film in a second cross-sectional direction perpendicular to the cross-sectional direction of FIG. 6.
Figure 8:
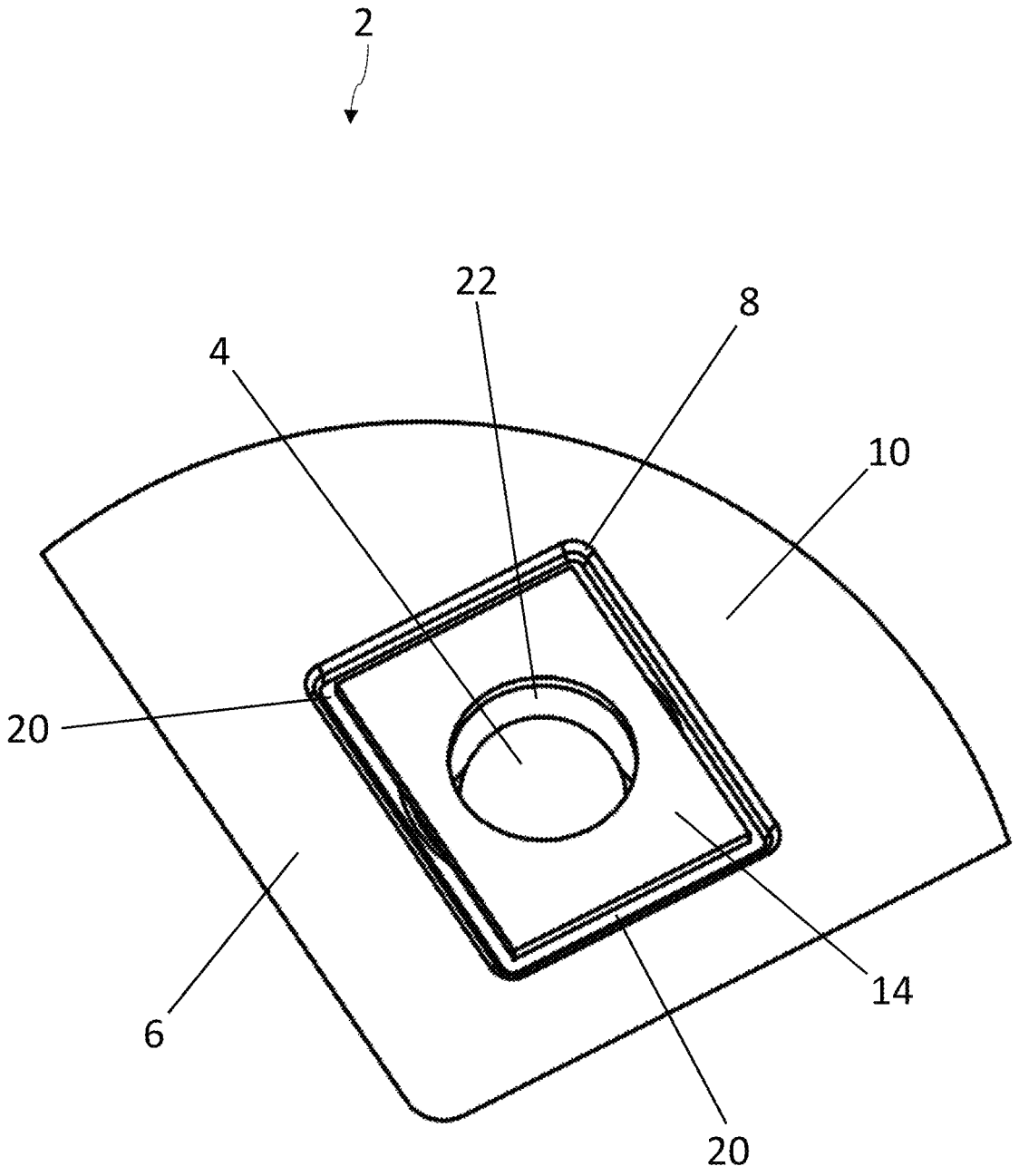
FIG. 8 is a perspective view of a part of another embodiment of a blister pack according to the disclosure, wherein the lidding film has been omitted for the sake of clarity.
Figure 9:
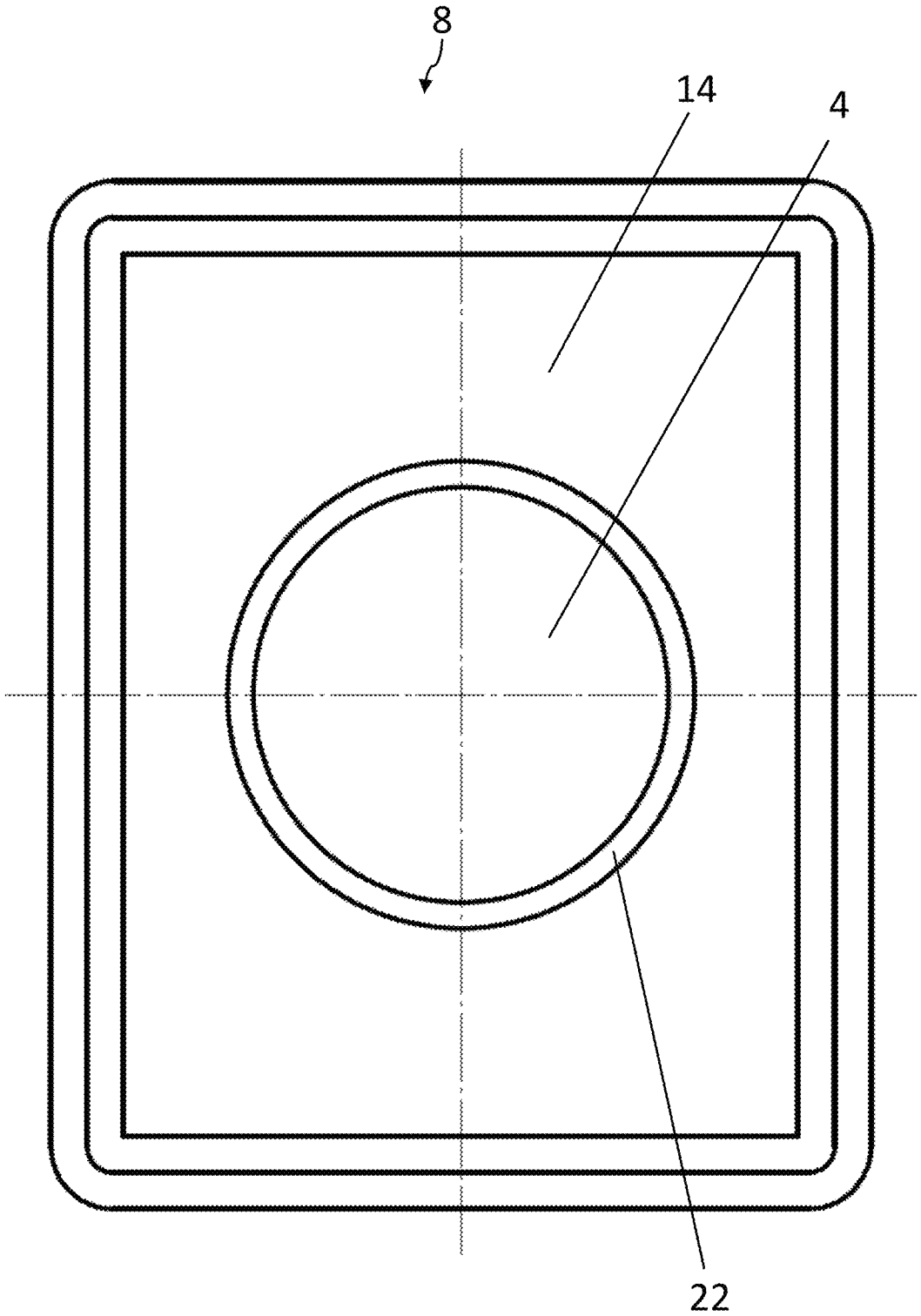
FIG. 9 is a top view of a blister pocket of the blister pack of FIG. 8, wherein the lidding film has been omitted for the sake of clarity.
Figure 10:
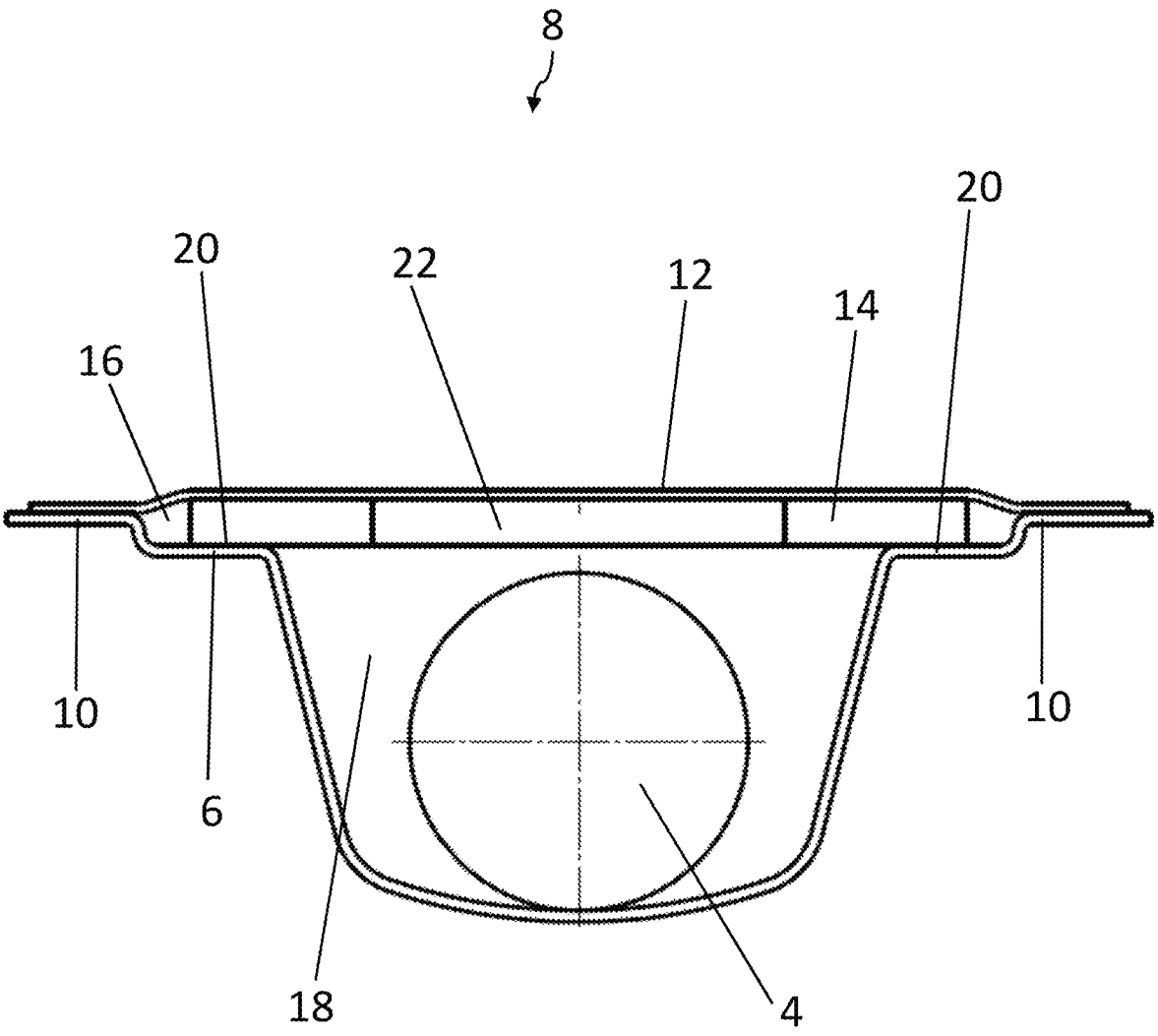
FIG. 10 is a cross-sectional view of a blister pocket of the blister pack of FIG. 8 with a sealed-on lidding film, in a first cross-sectional direction.
Figure 11:
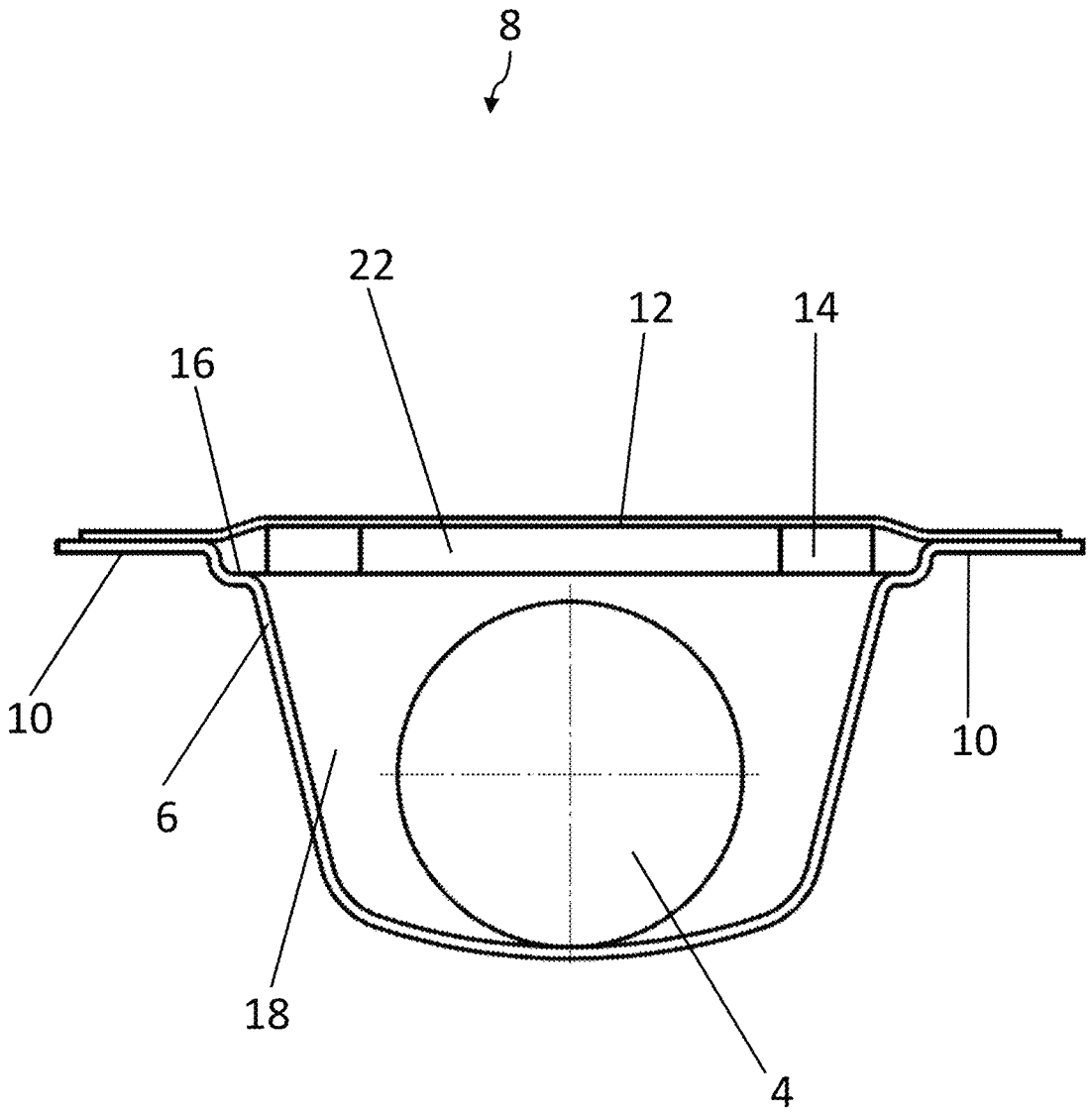
FIG. 11 is a cross-sectional view of blister pocket of the blister pack of FIG. 8 with a sealed-on lidding film, in a second cross-sectional direction perpendicular to the cross-sectional direction of FIG. 10.

FIGS. 1-3 show a first embodiment of a blister pack 2 according to the disclosure for medicinal products 4, especially tablets, capsules, or sugar-coated pills. The blister pack 2 comprises a bottom film 6, in which at least one blister pocket 8 is formed, which is surrounded by webs 10 of the bottom film 6. The part of the blister pack 2 illustrated in FIG. 1 shows only one blister pocket 8. Blister packs 2 usually comprise a plurality of blister pockets 8, which are usually distributed in a regular pattern over the blister pack 2. A frequently used arrangement of blister pockets 8 in a blister pack 2 is a matrix of rows and columns.

A lidding film 12, which covers at least one blister pocket 8, is sealed to the webs 10 of the bottom film 6 and closes off the at least one blister pocket 8. The lidding film 12 is shown only in FIG. 3, whereas, for the sake of clarity, it has been omitted in FIGS. 1 and 2.

Materials which can be used for the bottom film include in particular PVC, PVDC, Aclar, aluminum, PETG, and laminated films. Materials which can be used for the lidding film include in particular aluminum, polyethylene, polypropylene, paper-laminated films and other types of composite films.

A strip 14 of active material is arranged in the at least one blister pocket 8 and is sealed to the lidding film 12. The entire surface of the strip 14 can be sealed to the lidding film 12, or only certain areas of the strip 14, e.g., along lines or only at certain points, can be sealed to it.

As a result of its material properties, the active material usually has an absorption function for absorbing at least one substance or a release function for releasing at least one substance. The most widely encountered purpose is for the absorption of moisture. In the case of strips 14 with an absorption function, the strips 14 of active material can also absorb oxygen, $CO_2$, reactive impurities, or odors, for example. In the case of strips 14 with a release function, the strips 14 of active material can release nitrogen or carbon dioxide, for example.

A strip 14 of active material preferably has a thickness in the range of 0.2-2 mm, more preferably of 0.3-1.2 mm. The material of the strip 14 preferably has at least some stiffness to facilitate handling. The material of the strip 14 is preferably a film, more preferably a polymer, and even more preferably a three-phase polymer. The film can be produced by extrusion, for example, wherein the active particles are added to the polymer. Channels within the polymer allow the movement of gases. The active particles are preferably present in the strip 14 as spheres.

In the embodiment according to FIGS. 1-3, the product 4 has an oblong shape, and the strip 14 of active material has a substantially rectangular base surface. The strip 14 is arranged transversely to the product 4, preferably at an angle of approximately 45°. Standard dimensions of the strip 14 in the longitudinal and transverse directions are approximately in the range of 5-50 mm.

As can be seen in FIG. 3, each blister pocket 8 comprises a two-level shape, in which a first recess 16 defines a first level of the blister pocket 8. A second recess 18 is formed in a subsection of the two-dimensional area over which the first recess 16 extends and is situated lower down that the first recess 16. The medicinal product 4 is accommodated in the second recess 18, whereas the strip 14 of active material is accommodated in the first recess 16. The strip 14 of active material rests on the support surfaces 20 of the first recess 16, which are arranged next to the second recess 18. The strip 14 and the product 4 are therefore preferably a certain distance apart from each other in the vertical direction.

The two support surfaces 20 for the strip 14 of active material lie on two sides of the second recess 18, diametrically opposite each other. The strip 14 of active material therefore covers a large part of the second recess 18 and rests by two opposite corner areas on the support surfaces 20.

The embodiment of the blister pack 2 according to the disclosure shown in FIGS. 4-7 has a structure similar to that shown in FIGS. 1-3 and as previously described. Elements which are the same have been provided with the same reference numbers. In contrast to the embodiment of FIGS. 1-3, the medicinal product 4 has here a circular base surface. The strip 14 of active material again has a substantially rectangular base surface and rests by its two narrower edge areas on the support surfaces 20, which are arranged on opposite sides of the second recess 18. The strip 14 of active material therefore covers a large part of the product 4.

The embodiment of the blister pack 2 according to the disclosure shown in FIGS. 8-11 is again substantially identical to the embodiment according to FIGS. 1-3. Elements which are the same have been provided with the same reference numbers. The medicinal product 4 is configured here as a sphere. In contrast to the previously described embodiments, the strip 14 of active material has an opening 22, which is arranged above the medicinal product 4. The medicinal product 4 can therefore pass through the opening 22 in the strip 14 when it is being squeezed out. The area of the lidding film 12 sealed to the strip 14 of active material is therefore not broken open when the product 4 is squeezed out, but only the area of the lidding film 12 above the opening 22 is broken.

The shape of the blister pockets 8 can depart from the configurations described so far. Any geometric configuration is conceivable, as long as the blister pocket 8 has an at least two-level shape. The shape of the second recess 18 depends preferably on the shape of the product 4 to be packaged, which can have any possible geometric shape. In addition to the oblong form, the sugar-coated pill form, or the spherical form discussed so far, triangular or polygonal shapes of the medicinal products 4 can also be present.

Finally, the shape of the strip 14 of active material can depart from the exemplary embodiments described so far. In addition to the rectangular base surface illustrated, the strips 14 can also have a round, an oval, or a triangular base surface. In each of these configurations, it is possible to provide an opening 22 in the strip. The strips 14 are usually cut-to-size blanks.

The support surfaces 20 for the strips 14 of active material can be arranged on two opposite sides of the second recess 18, as illustrated in the previous exemplary embodiments. It is also possible, however, for more than two support surfaces 20 to be arranged around the second recess 18 or for a single continuous support surface 20 to extend all the way around the second recess 18.

Figure 12:
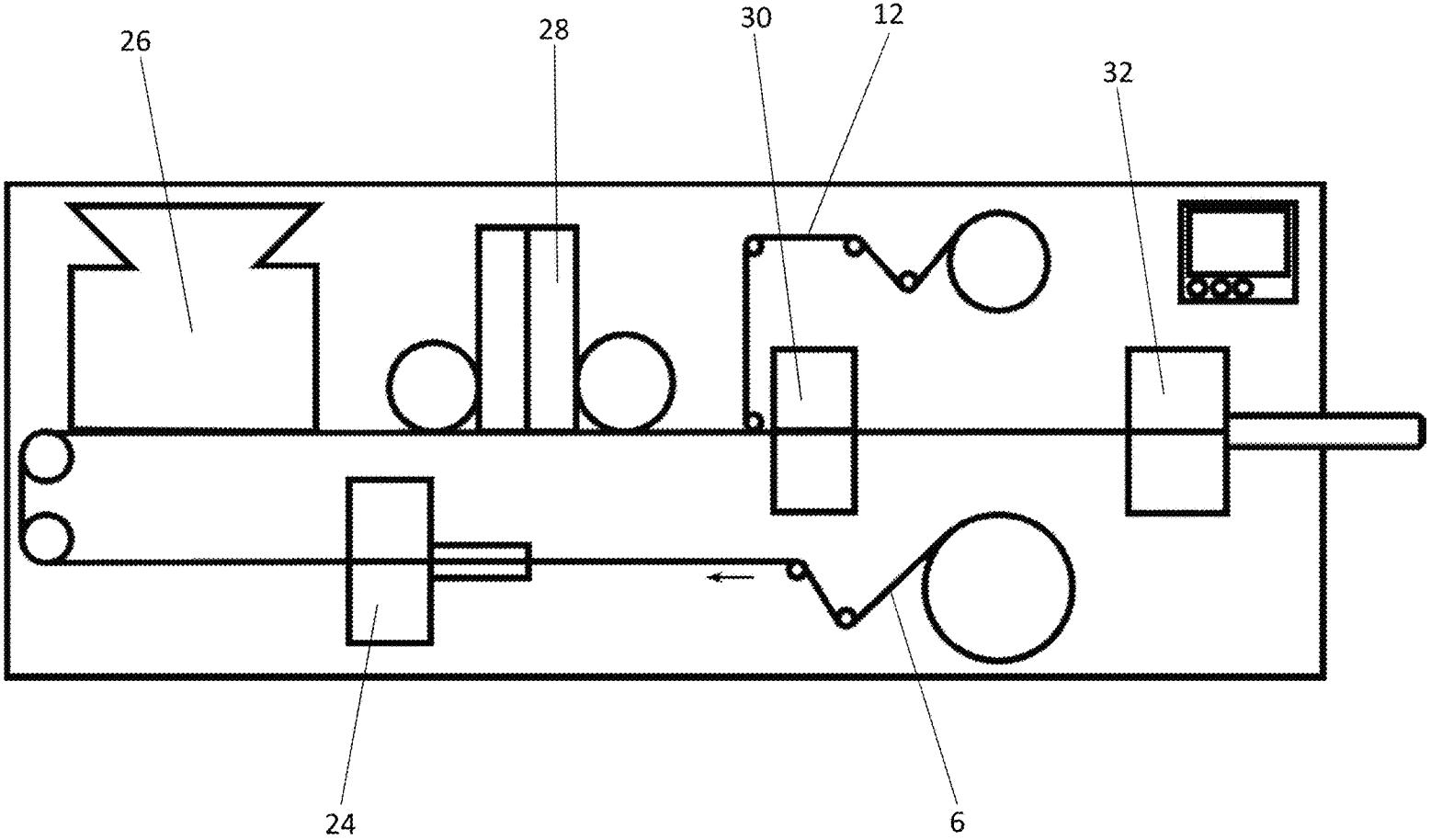
FIG. 12 is a schematic diagram of a system for carrying out the method according to the disclosure for producing blister packs.

A method according to the disclosure for producing blister packs 2 will now be described with reference to FIG. 12. First, a bottom film 6 in the form of a roll is provided and unwound. In a forming station 24, the blister pockets 8 are formed in the unwound bottom film 6, wherein each blister pocket 8 has the previously described shape with at least two levels. Then, in a filling station 26, the second recesses 18 of the blister pockets 8 are filled with the medicinal products 4.

In a feed station 28, the strips 14 of active material are then provided, and a strip 14 of active material is placed in the first recess 16 of each blister pocket 8 above the medicinal product 4, i.e., on the at least one support surface 20 of the first recess 16. The at least one support surface 20 of the first recess 16 is therefore preferably arranged above the medicinal product 4, more preferably a certain distance away from it. The step of providing the strips 14 of active material is preferably achieved by providing a web of active material wound up into a roll and by stamping out the strips 14 of active material from the unwound web. The placing of the strips 14 of active material is preferably achieved by means of a pick-and-place device. It is also possible, however, to provide other means of transferring the strips 14 of active material.

The lidding film 12 is provided in a following sealing station 30 and sealed to the webs 10 of the bottom film 6. At the same time, the lidding film 12 is also sealed to the strips 14 of active material. All these steps taken together thus lead to the formation of a sealed blister web. Finally, the individual blister packs 2 are stamped out of the blister web in a downline stamping station 32. The individual blister packs 2 are then sent onward for further processing measures.

Figure 13:
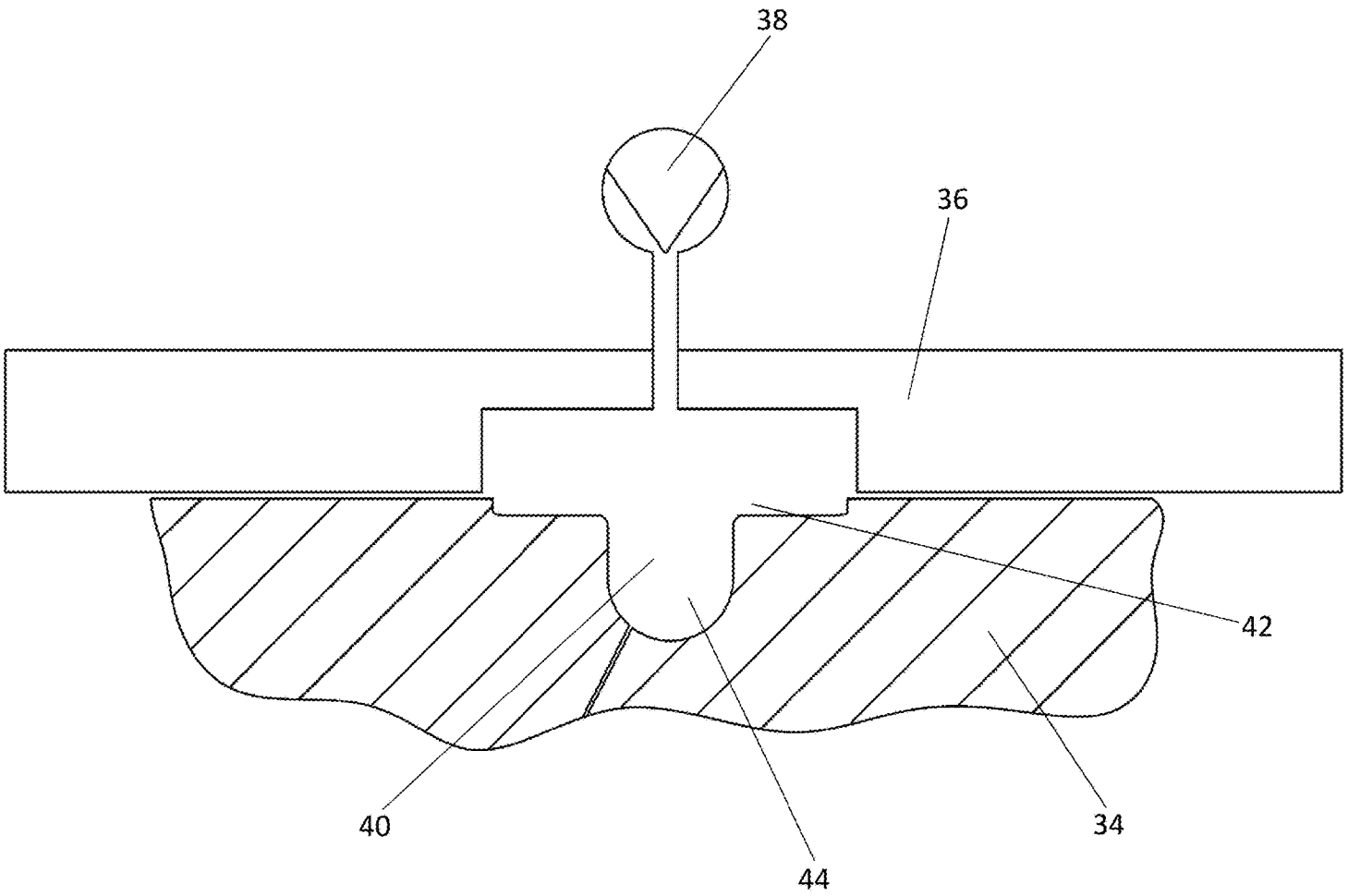
FIG. 13 is a schematic, cross-sectional view of a forming device which can be used in the method according to the disclosure for producing blister packs.

A first forming tool 34 and a second forming tool 36, which cooperate in the forming station 24 to form the blister pockets 8 in the bottom film 6, are sketched in FIG. 13. The two forming tools 34, 36 can be moved relative to each other between an opened position and a closed or forming position. For this purpose, at least one of the two forming tools 34, 36, preferably both of them, must be movable. In the closed forming position, the two forming tools 34, 36 clamp the bottom film 6 between them for the forming operation. A source of compressed air 38 is connected to the second forming tool 36 to bring about the formation of the blister pocket 8 in the firmly clamped bottom film 6.

The first forming tool 34 comprises at least one, preferably a plurality, of troughs 40 for forming at least one blister pocket 8 in the bottom film 6. The at least one trough 40 has an at least two-level shape. A first recess 42 of the trough 40 defines a first level of the trough 40. A second recess 44 of the trough 40 is arranged in a subsection of a two-dimensional area over which the first recess 42 extends and is situated lower down than the first recess 42. The shape of the trough 40 corresponds to the shape of the blister pockets 8 to be formed. The shape of the trough 40 shown in FIG. 14 corresponds, for example, to the shape of the blister pocket 8 of the blister pack 2 of FIGS. 1-3.

Figure 15:
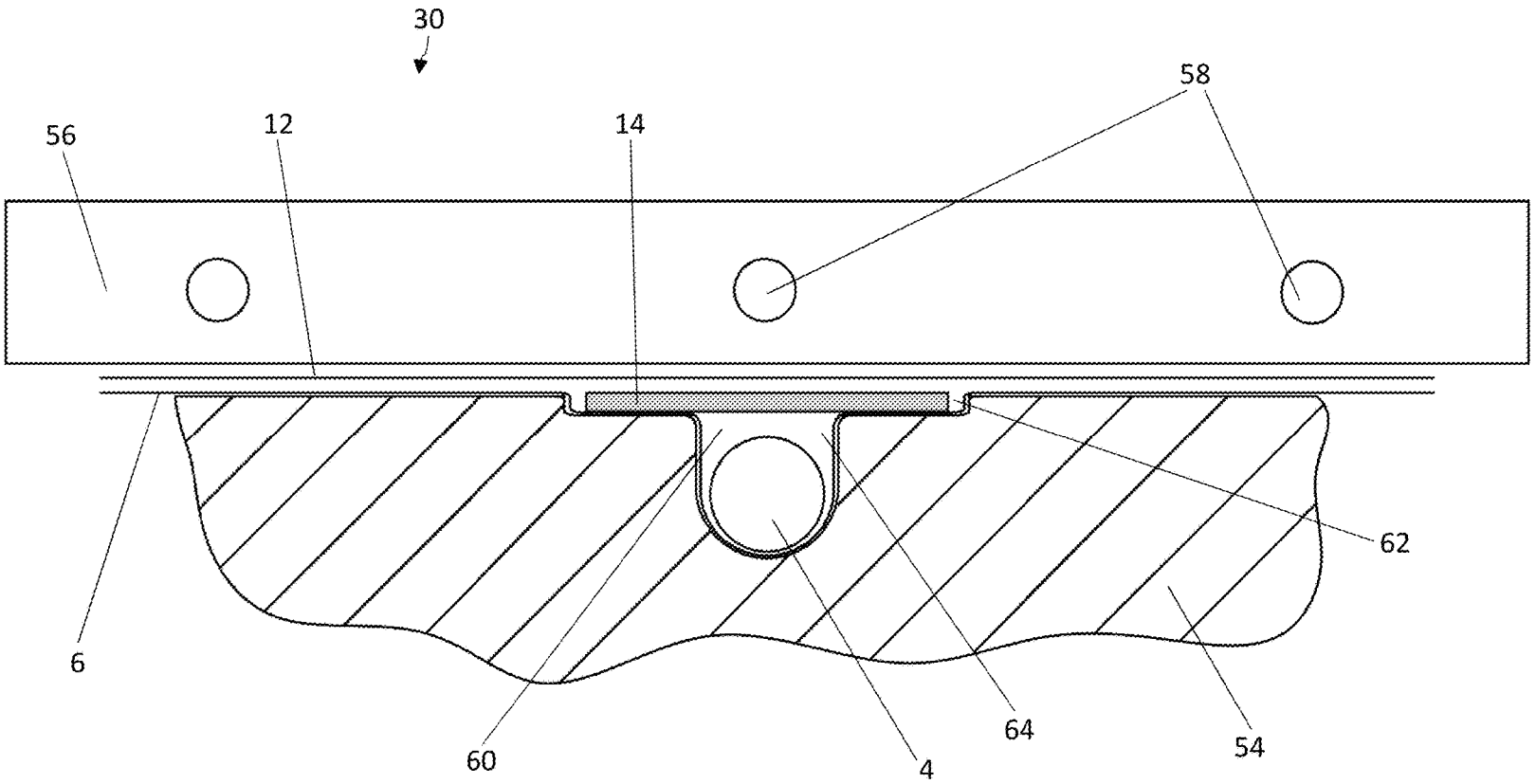
FIG. 15 is a schematic, cross-sectional view of a sealing device which can be used in the method according to the disclosure for producing blister packs, in an opened position.
Figure 16:
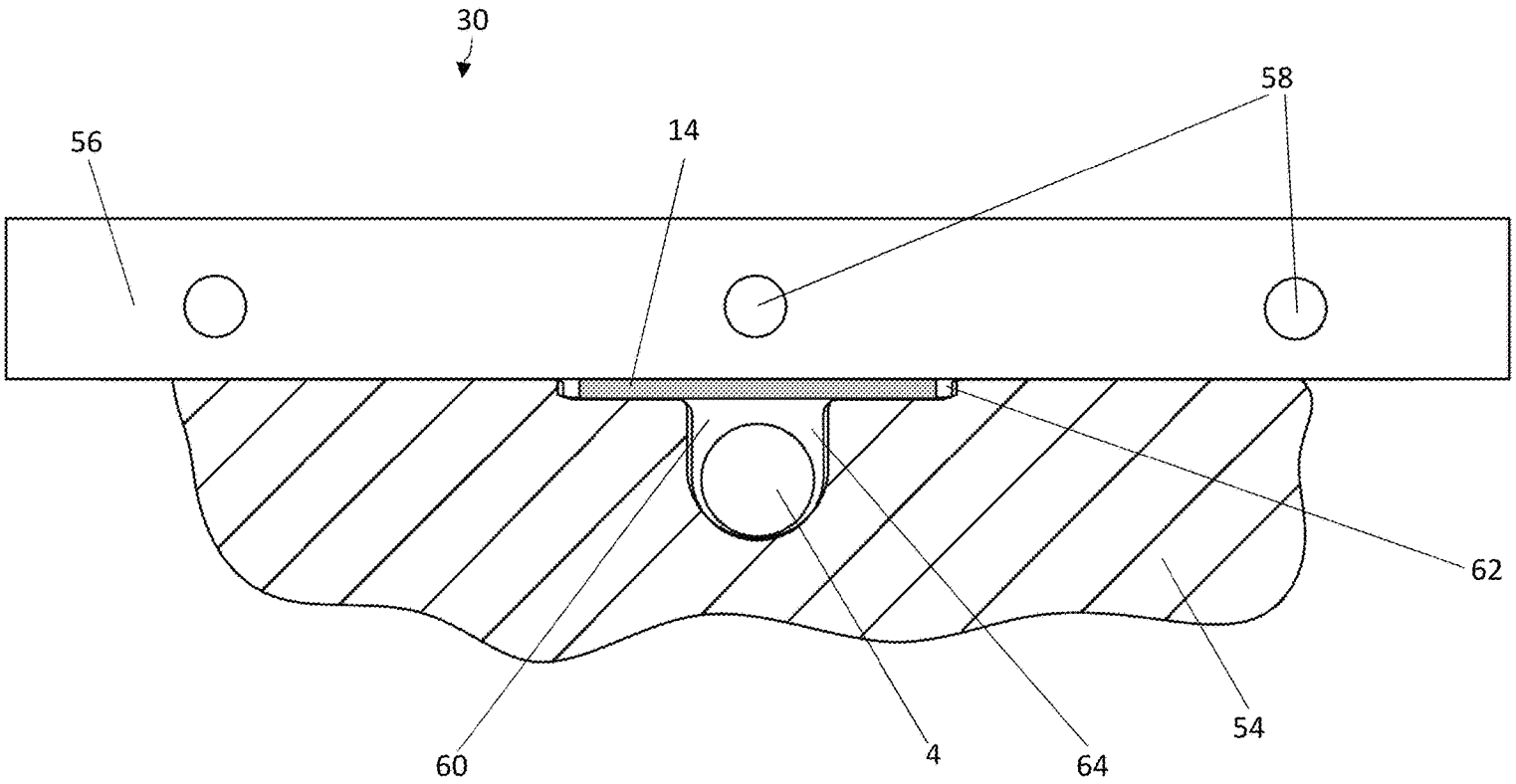
FIG. 16 is a schematic, cross-sectional view of the sealing device of FIG. 15 in a closed sealing position.

A first sealing tool 54 and a second sealing tool 56, which cooperate in the sealing station 30 to seal the lidding film 12 to the webs 10 of the bottom film 6 and to the strips 14 of active material, are sketched in FIGS. 15 and 16. The two sealing tools 54, 56 are movable relative to each other between an opened position (FIG. 15) and a closed sealing position (FIG. 16). For this purpose, at least one of the two sealing tools 54, 56, preferably both of them, must be movable. In the closed sealing position, the two sealing tools 54, 56 press the lidding film 12 against the webs 10 of the bottom film 6 and against the strips 14 of active material. The second sealing tool 56 comprises at least one heating means 58. The first sealing tool 54 can comprise a cooling means (not shown).

The first sealing tool 54 comprises at least one, preferably a plurality, of troughs 60 for accommodating at least one blister pocket 8 of the bottom film 6. The at least one trough 60 comprises an at least two-level shape. A first recess 62 of the trough 60 defines a first level of the trough 60. A second recess 64 of the trough 60 is arranged in a subsection of the two-dimensional area over which the first recess 62 extends and is situated lower down than the first recess 62. The shape of the trough 60 corresponds substantially to the shape of the blister pockets 8 previously formed in the forming station 24. In this concrete example, the shape of the trough 60 corresponds to that of the blister pack of FIGS. 1-3.

When the strips 14 of active material are placed on the at least one support surface 20 of the first recess 16, it is advantageous for the strips 14 of active material to project upward beyond the webs 10 of the bottom film by an amount in the range of 0.05-0.5 mm, more preferably of 0.08-0.2 mm. The geometry of the blister pocket 8 and of the first recess 62 in the first sealing tool 54 is therefore to be adapted correspondingly to the thickness of the strip 14 of active material, so that the strip 14 projects by this amount prior to the sealing operation in the sealing station 30. This projection of the strip 14 guarantees that the lidding film 12 will be sealed not only to the webs 10 of the bottom film 6 but also to the strips 14 of active material.

Figure 17:
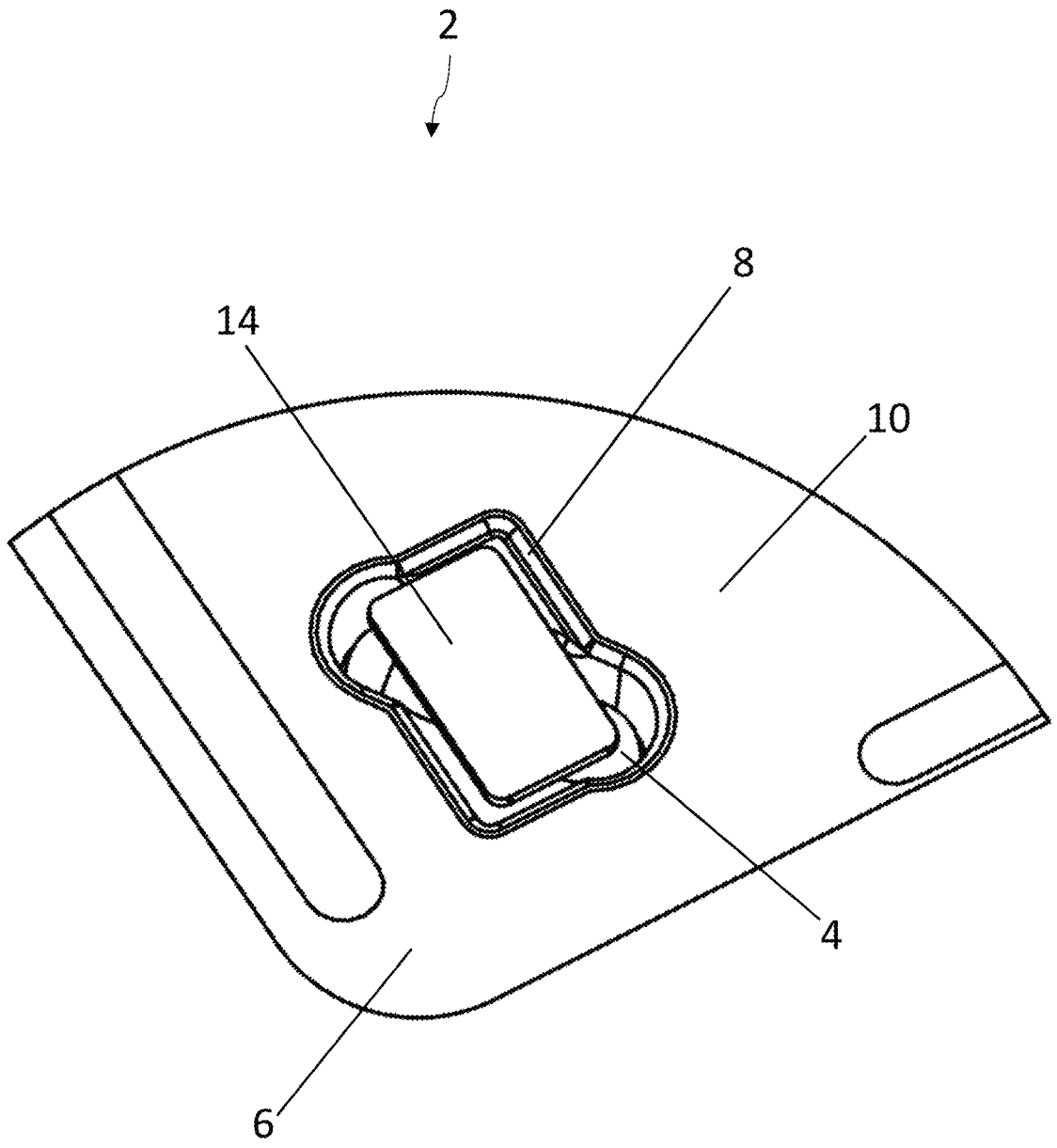
FIG. 17 is a perspective view of a part of another embodiment of a blister pack according to the disclosure, wherein the lidding film has been omitted for the sake of clarity.
Figure 18:
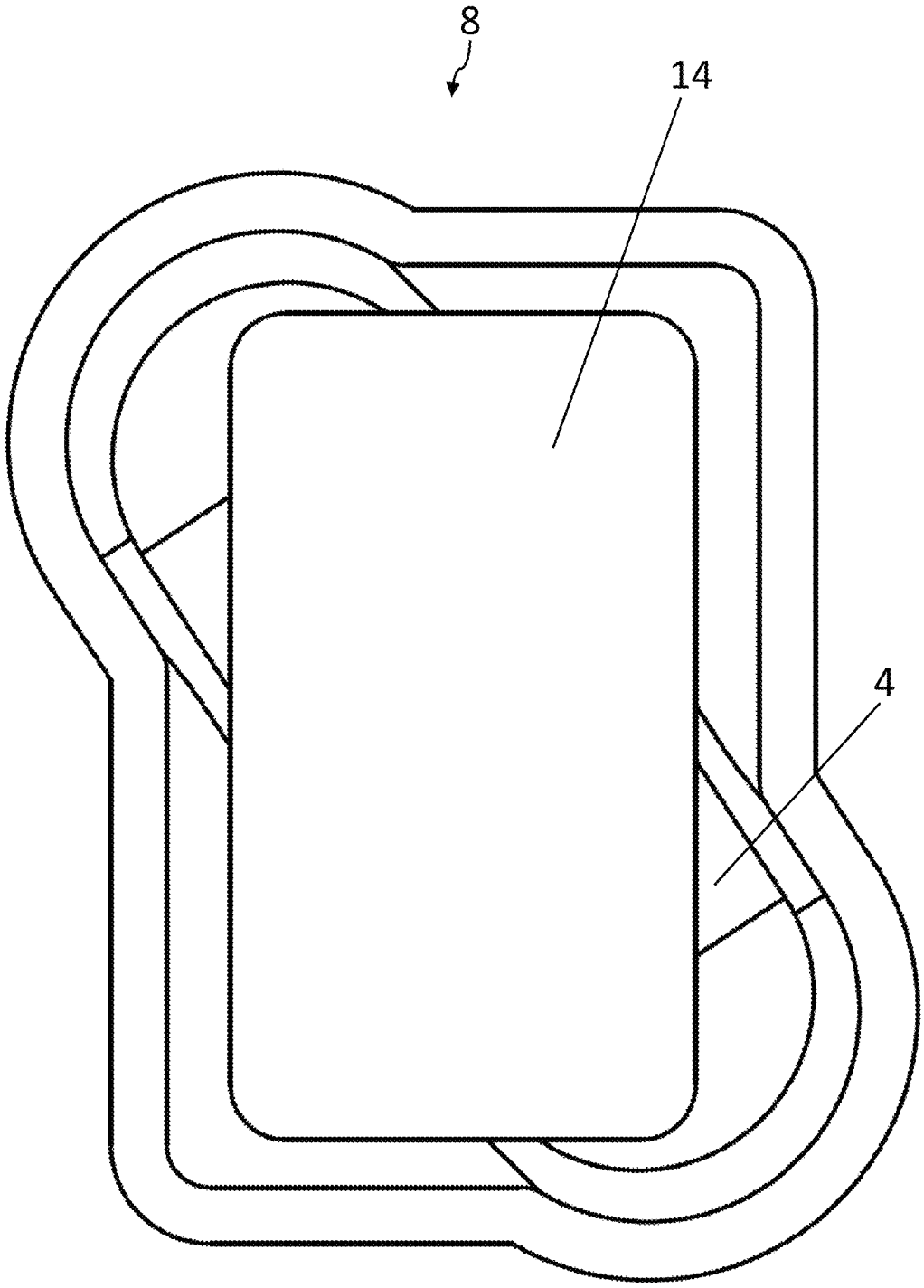
FIG. 18 is a top view of a blister pocket of the blister pack of FIG. 17, wherein the lidding film has been omitted for the sake of clarity.
Figure 19:
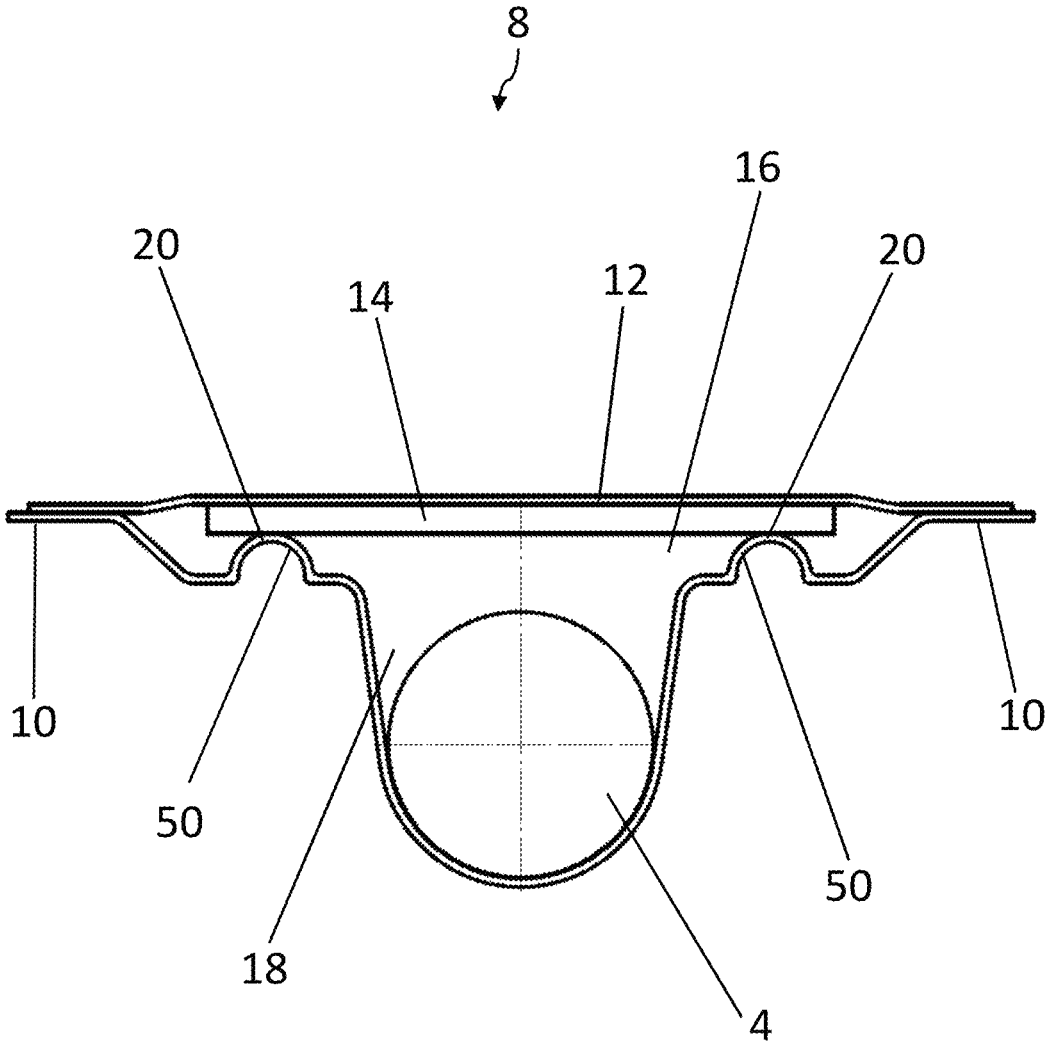
FIG. 19 is a cross-sectional view of a blister pocket of the blister pack of FIG. 17 with a sealed-on lidding film.
Figure 20:
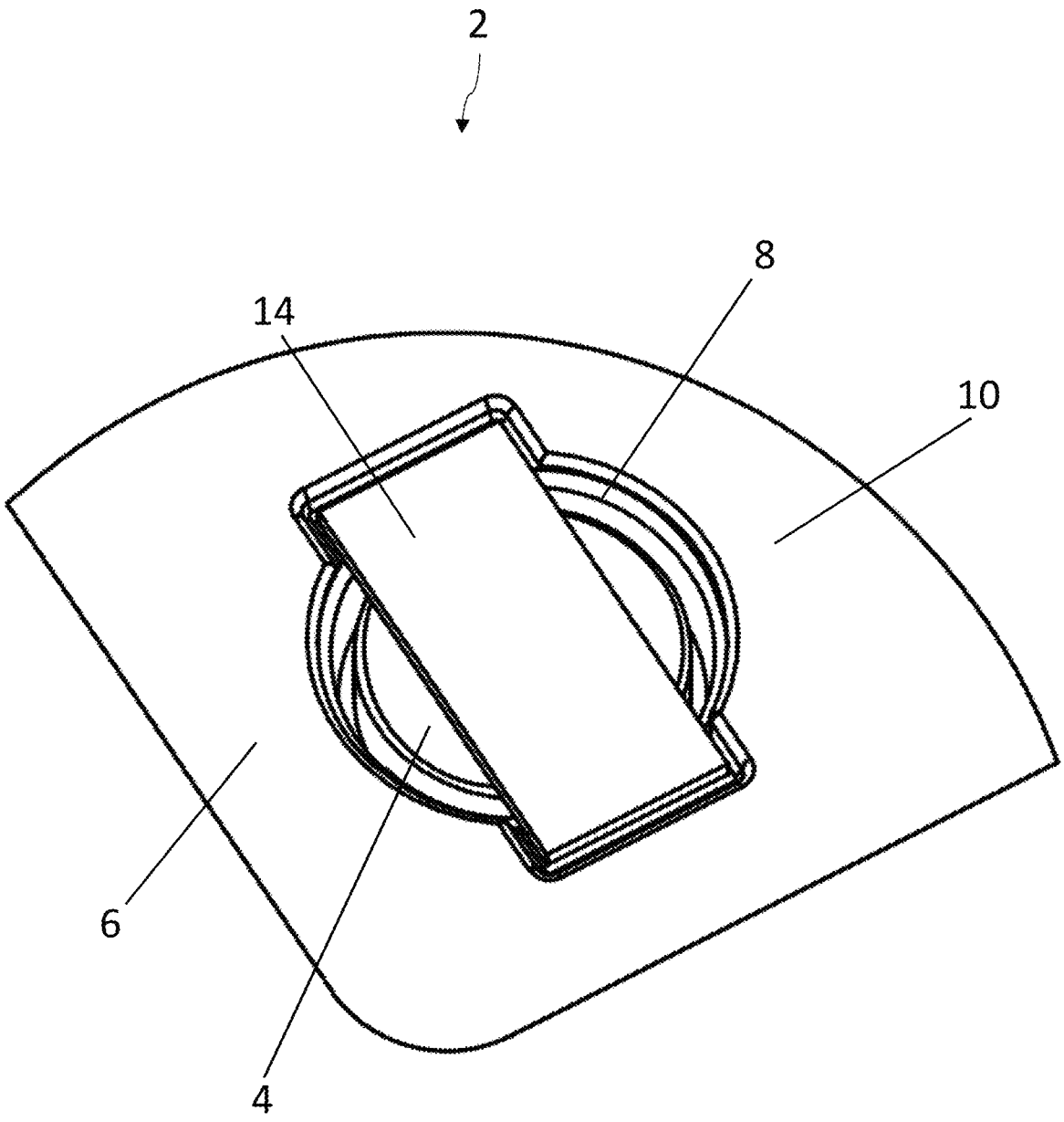
FIG. 20 is a perspective view of a part of another embodiment of a blister pack according to the disclosure, wherein the lidding film has been omitted for the sake of clarity.
Figure 21:
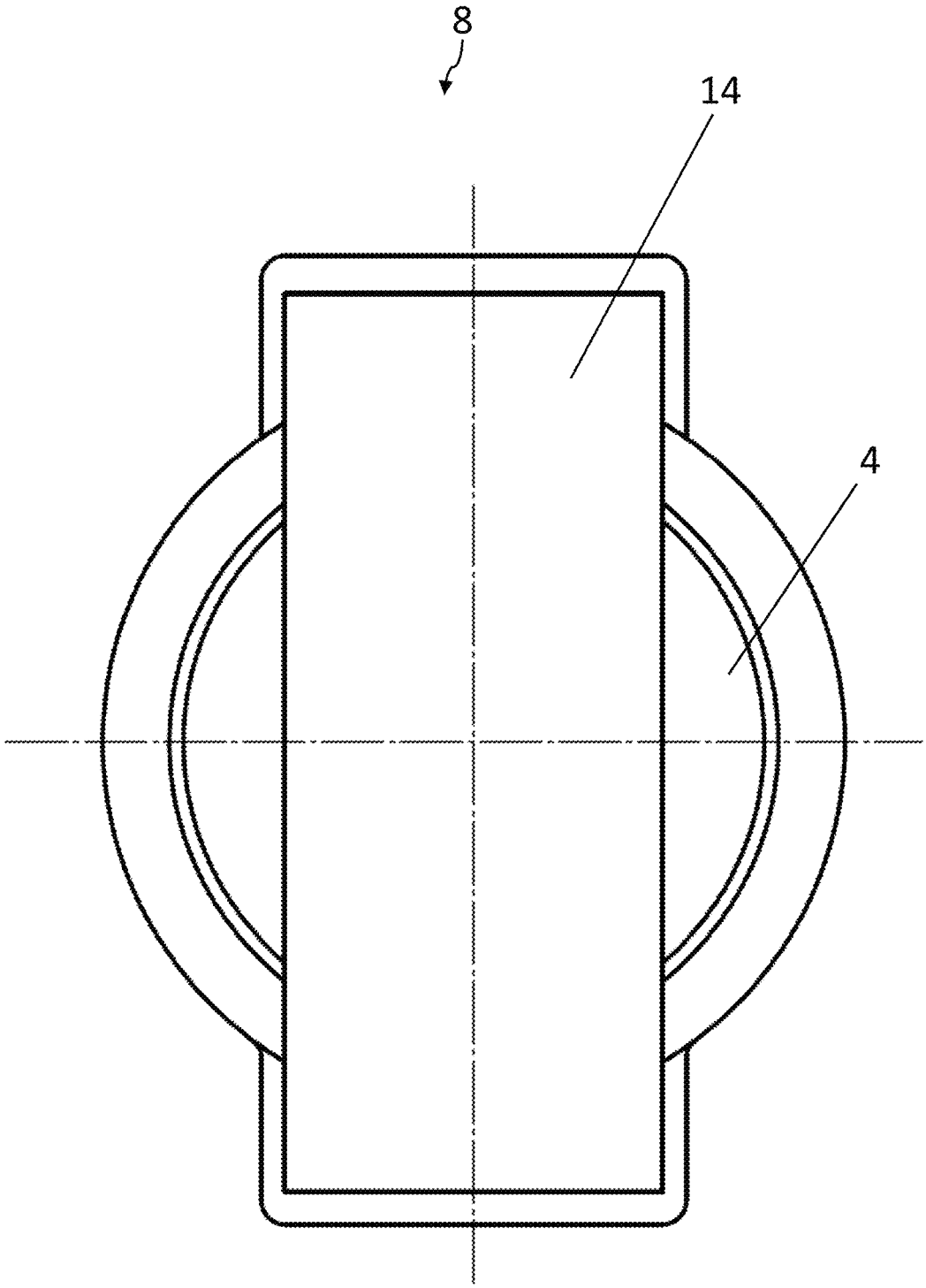
FIG. 21 is a top view of a blister pocket of the blister pack of FIG. 20, wherein the lidding film has been omitted for the sake of clarity.
Figure 22:
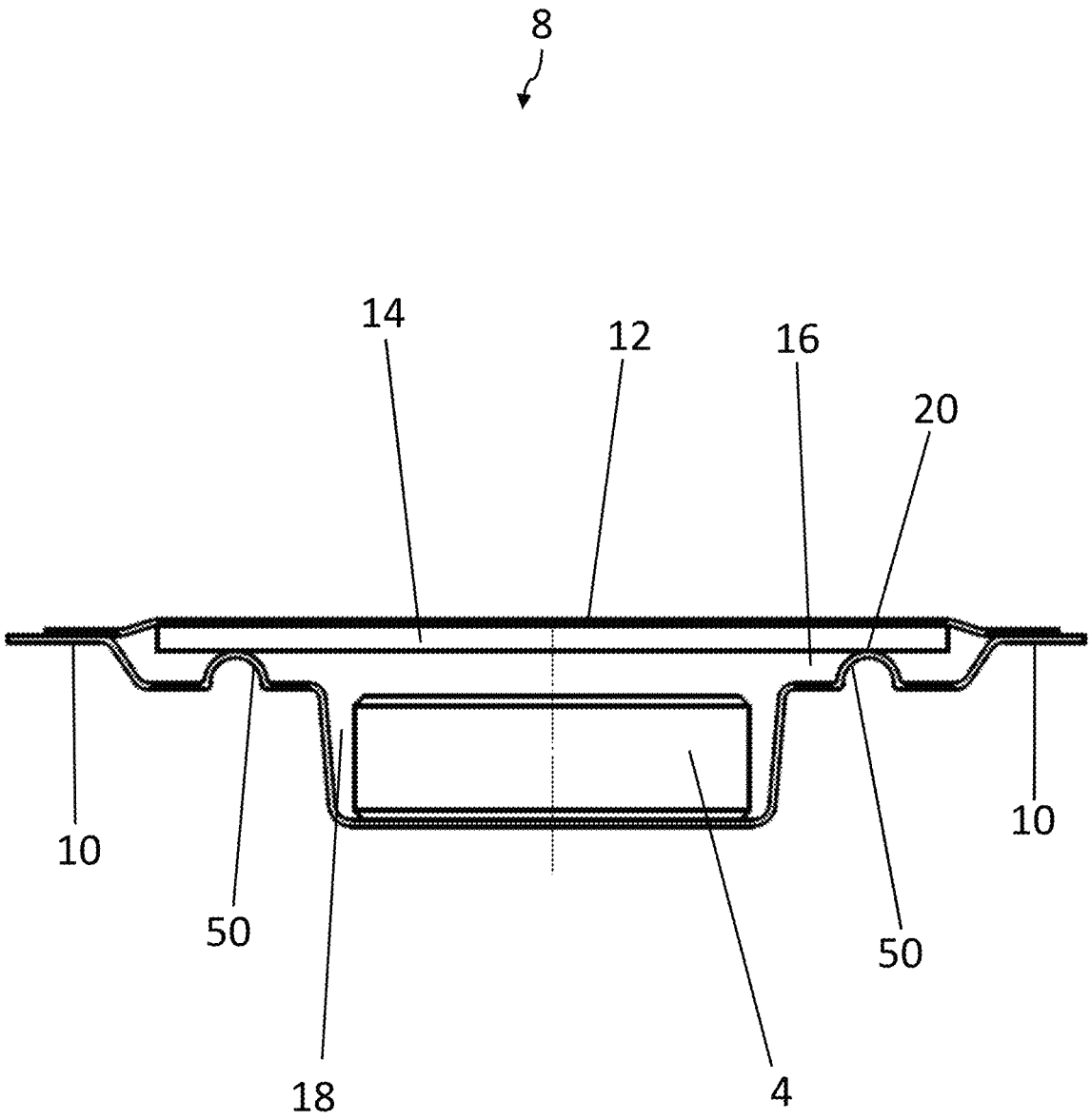
FIG. 22 is a cross-sectional view of a blister pocket of the blister pack of FIG. 20 with a sealed-on lidding film.
Figure 23:
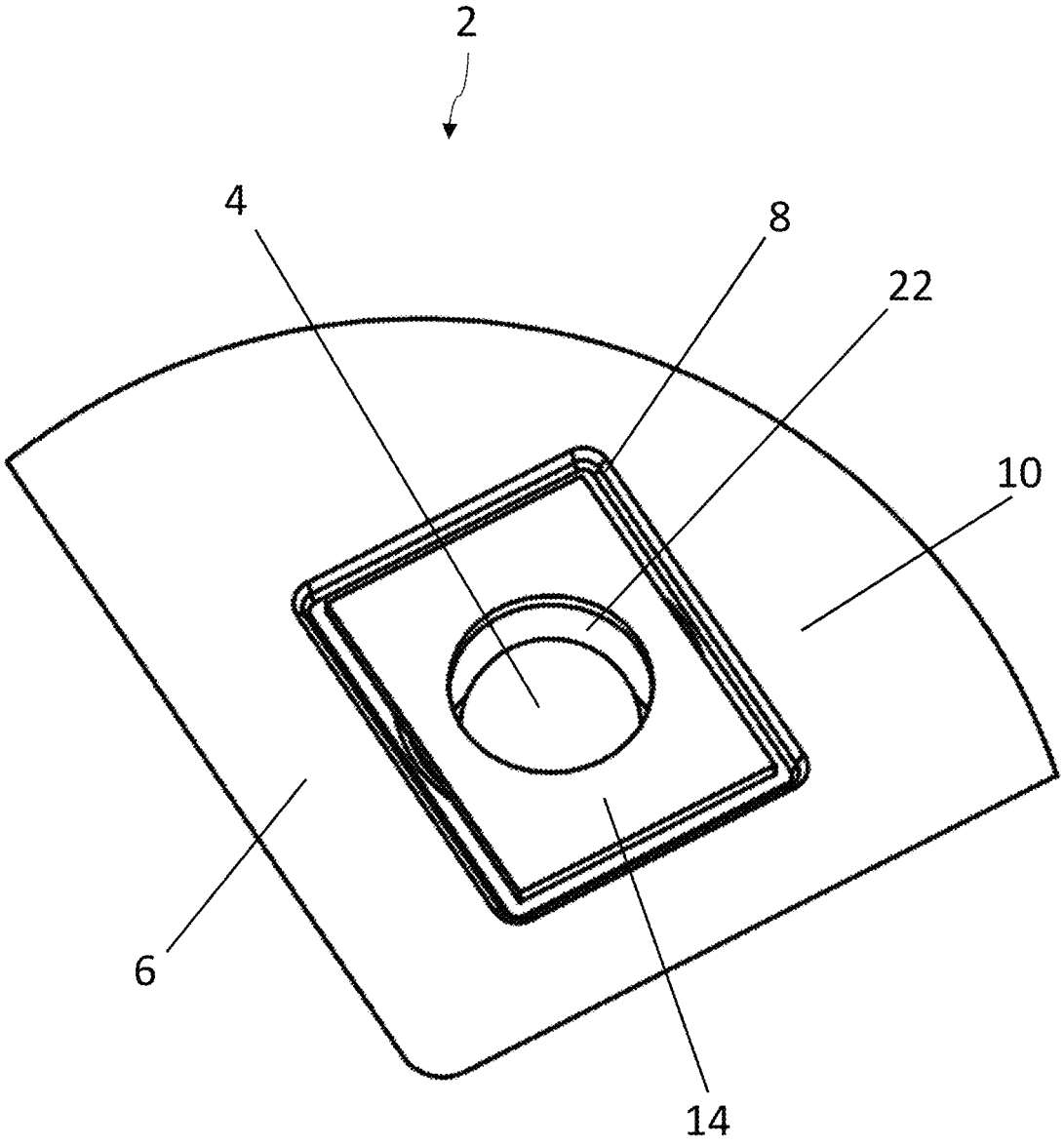
FIG. 23 is a perspective view of a part of another embodiment of a blister pack according to the disclosure, wherein the lidding film has been omitted for the sake of clarity.
Figure 24:
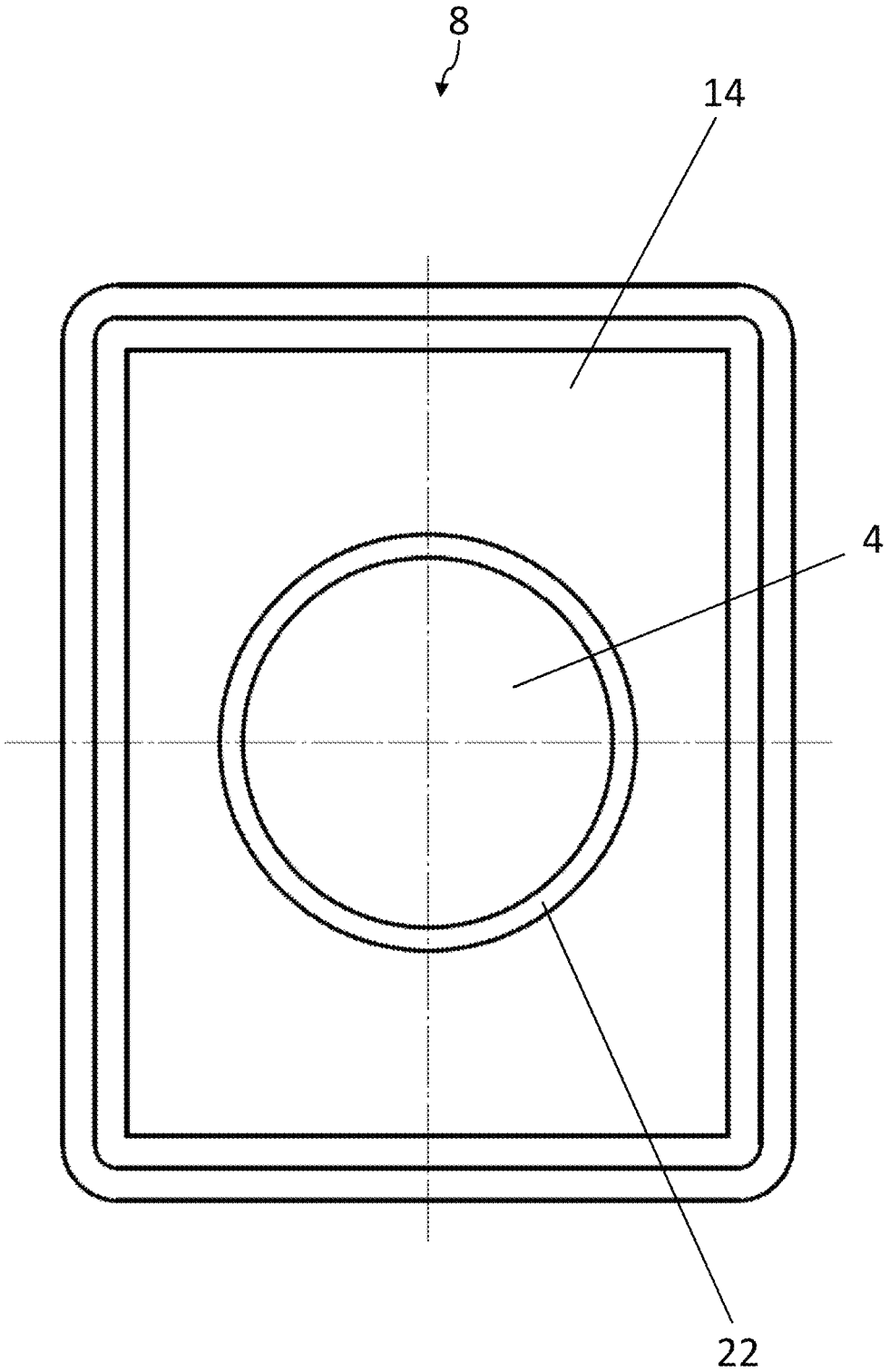
FIG. 24 is a top view of a blister pocket of the blister pack of FIG. 23, wherein the lidding film has been omitted for the sake of clarity.
Figure 25:
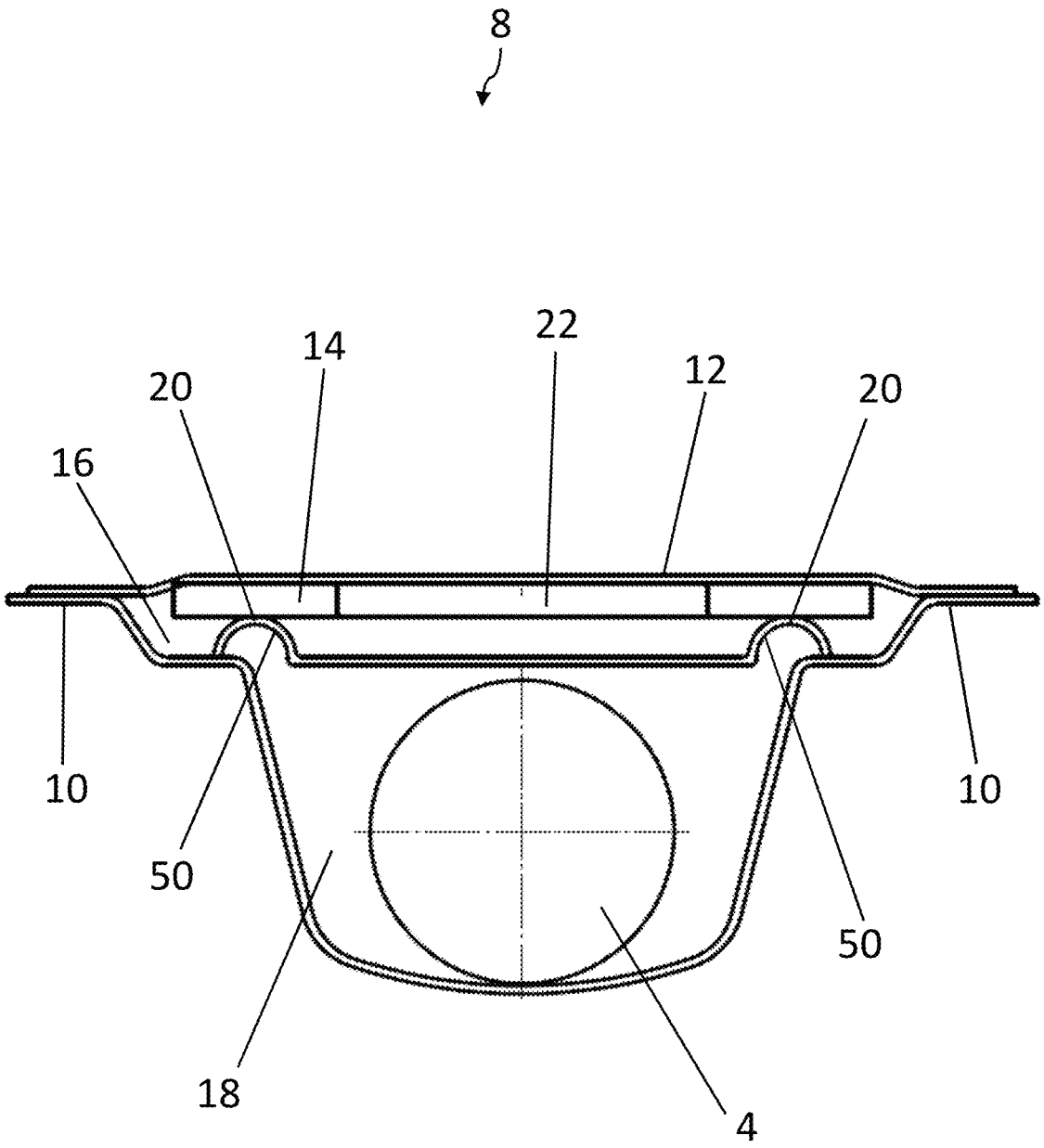
FIG. 25 is a cross-sectional view of a blister pocket of the blister pack of FIG. 23 with a sealed-on lidding film.

Another embodiment of the blister pack 2 according to the disclosure is shown in FIGS. 17-19. This embodiment corresponds in its essential features to the embodiment of FIGS. 1-3. FIG. 17 corresponds to the illustration in FIG. 1, FIG. 18 to the illustration in FIG. 2, and FIG. 19 to the illustration in FIG. 3. To this extent, the description of FIGS. 1-3 applies to the present embodiment unless otherwise indicated. Elements which are the same have been provided with the same reference numbers.

In a departure from the embodiment of FIGS. 1-3, the support surfaces 20 for the strip 14 of active material are formed by two upward-projecting knobs 50 in the bottom film 6, located in the area of the first recess 16. The two knobs 50 can be seen only in the cross-sectional view of FIG. 19, because they are concealed by the strip 14 in the other two views.

Figure 26:
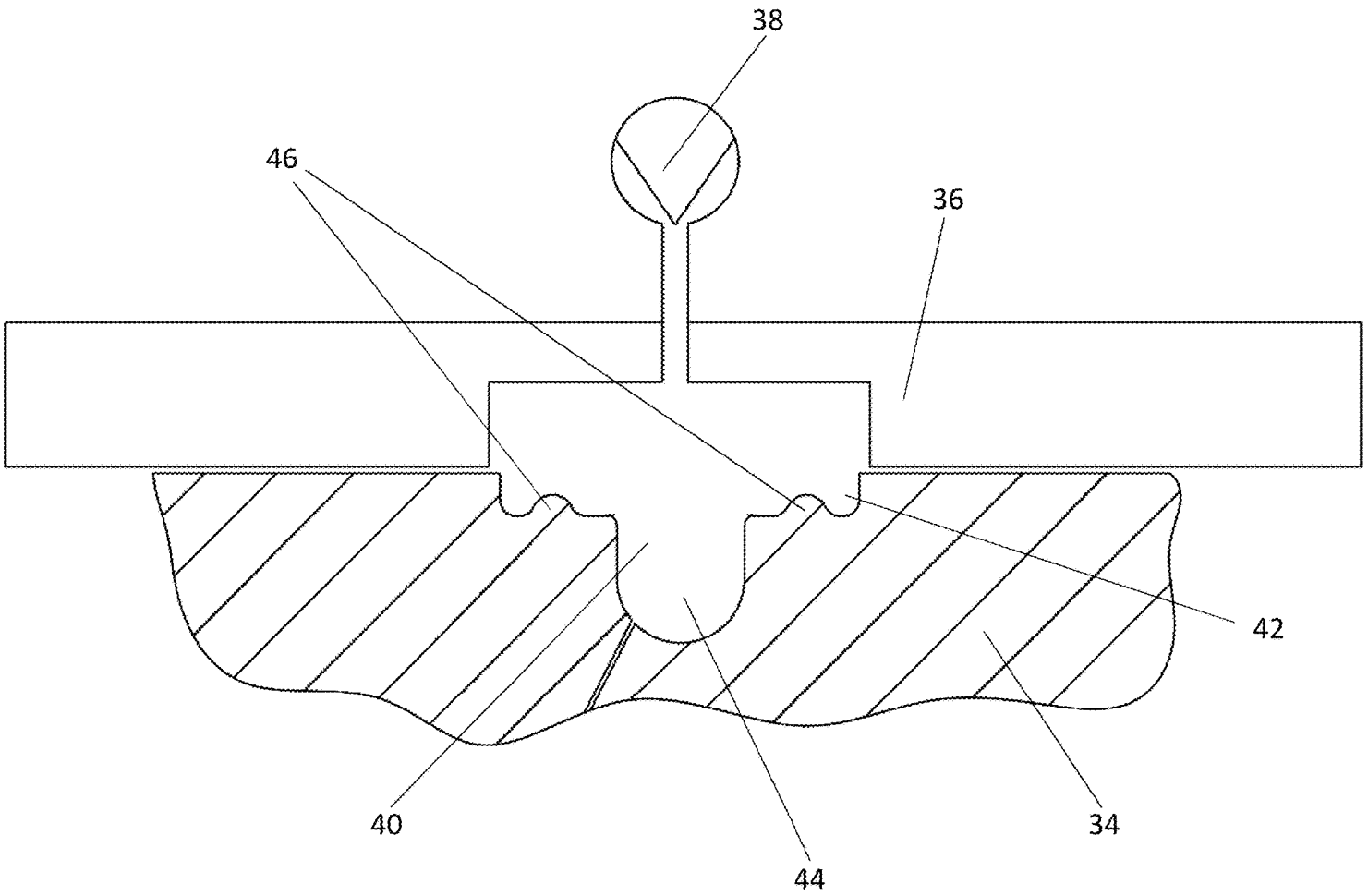
FIG. 26 is a schematic, cross-sectional view of another forming device which can be used in the method according to the disclosure for producing blister packs.
Figure 27:
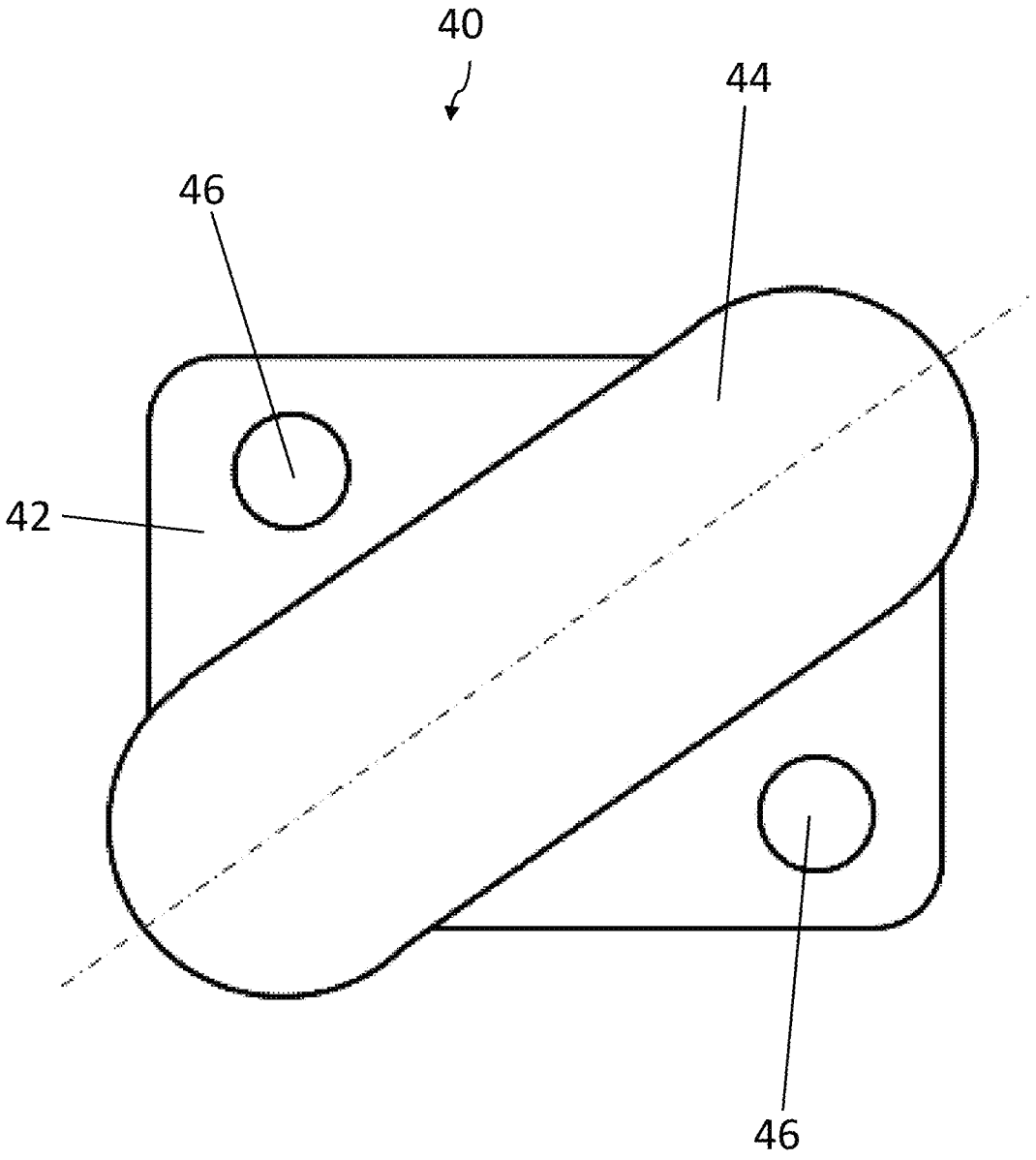
FIG. 27 is a top view of the recess in the lower forming tool of FIG. 26.

Another possible configuration of the forming tools 34, 36 is shown in FIGS. 26 and 27. This configuration corresponds in its essential features to the embodiment of FIGS. 13 and 14. FIG. 26 corresponds to the illustration in FIG. 13, FIG. 27 to the illustration in FIG. 14. To this extent, the description of FIGS. 13 and 14 applies to the present configuration unless otherwise indicated. Elements which are the same have been provided with the same reference numbers.

Figure 14:
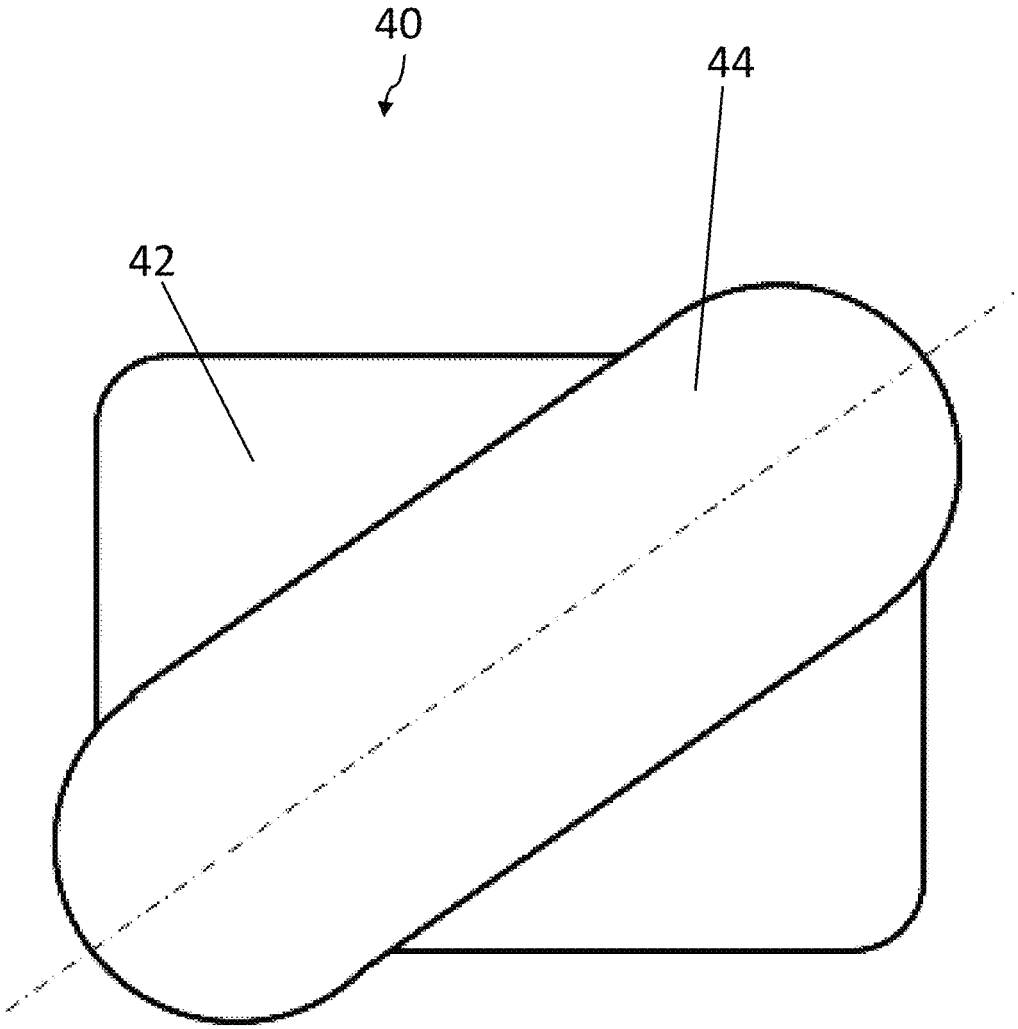
FIG. 14 is a top view of the recess in the lower forming tool of FIG. 13.

In a departure from the embodiment of FIGS. 13 and 14, the first forming tool 34 comprises two upright projections 46 in the area of the first recess 42 of the trough 40; these projections are arranged next to the second recess 44. As a result, when the blister pockets 8 are being formed in the bottom film 6, two upward-projecting knobs 50 are formed in the bottom film 6, which serve as the support surfaces for the strips 14 of active material. In FIG. 27, the two projections 46 can again be seen, this time in a top view. The blister pack 2 of FIGS. 1-3 is formed by means of the forming tool 34 shown here.

Figure 28:
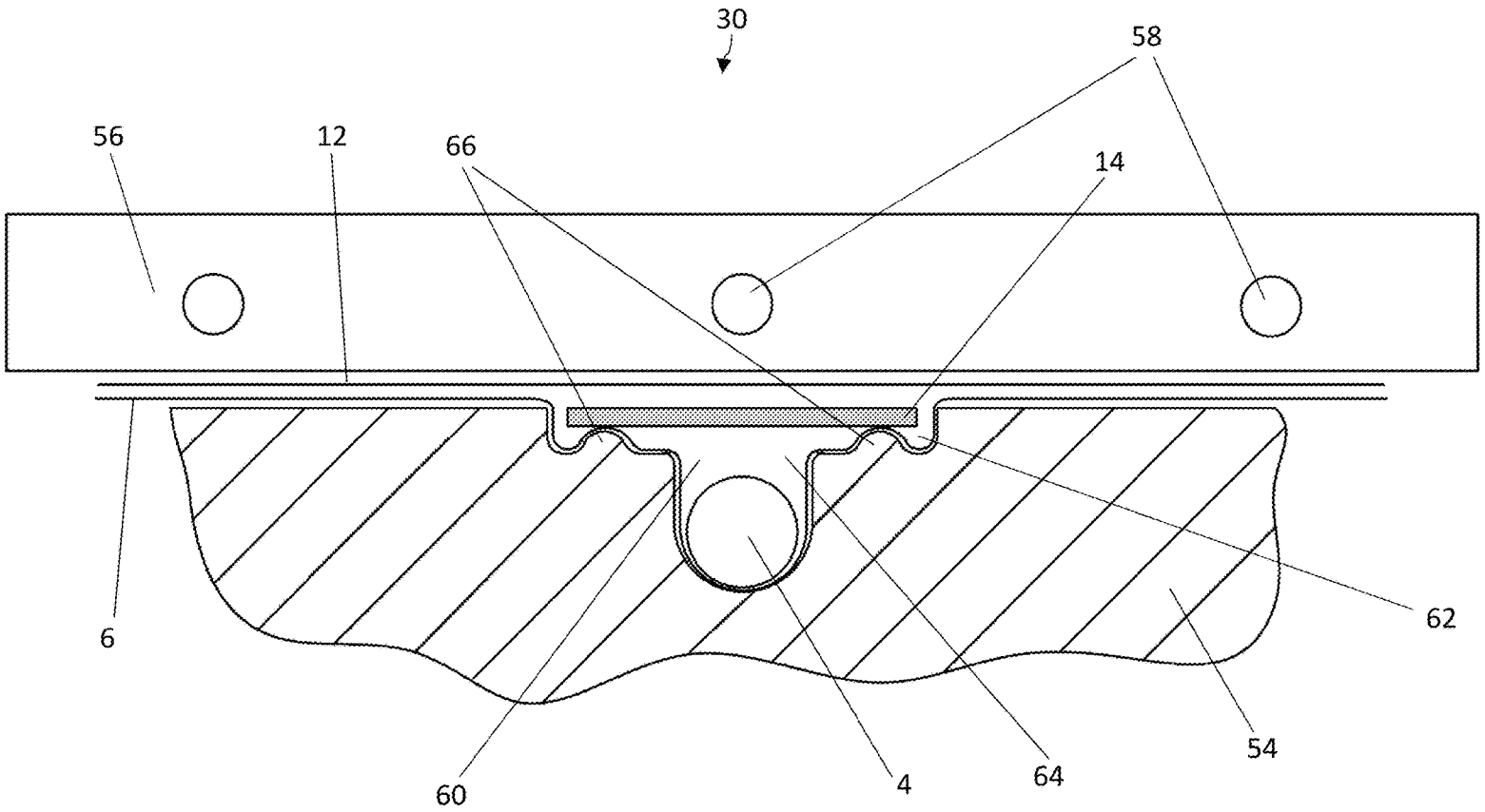
FIG. 28 is a schematic, cross-sectional view of another sealing device which can be used in the method according to the disclosure for producing blister packs, in an opened position.
Figure 29:
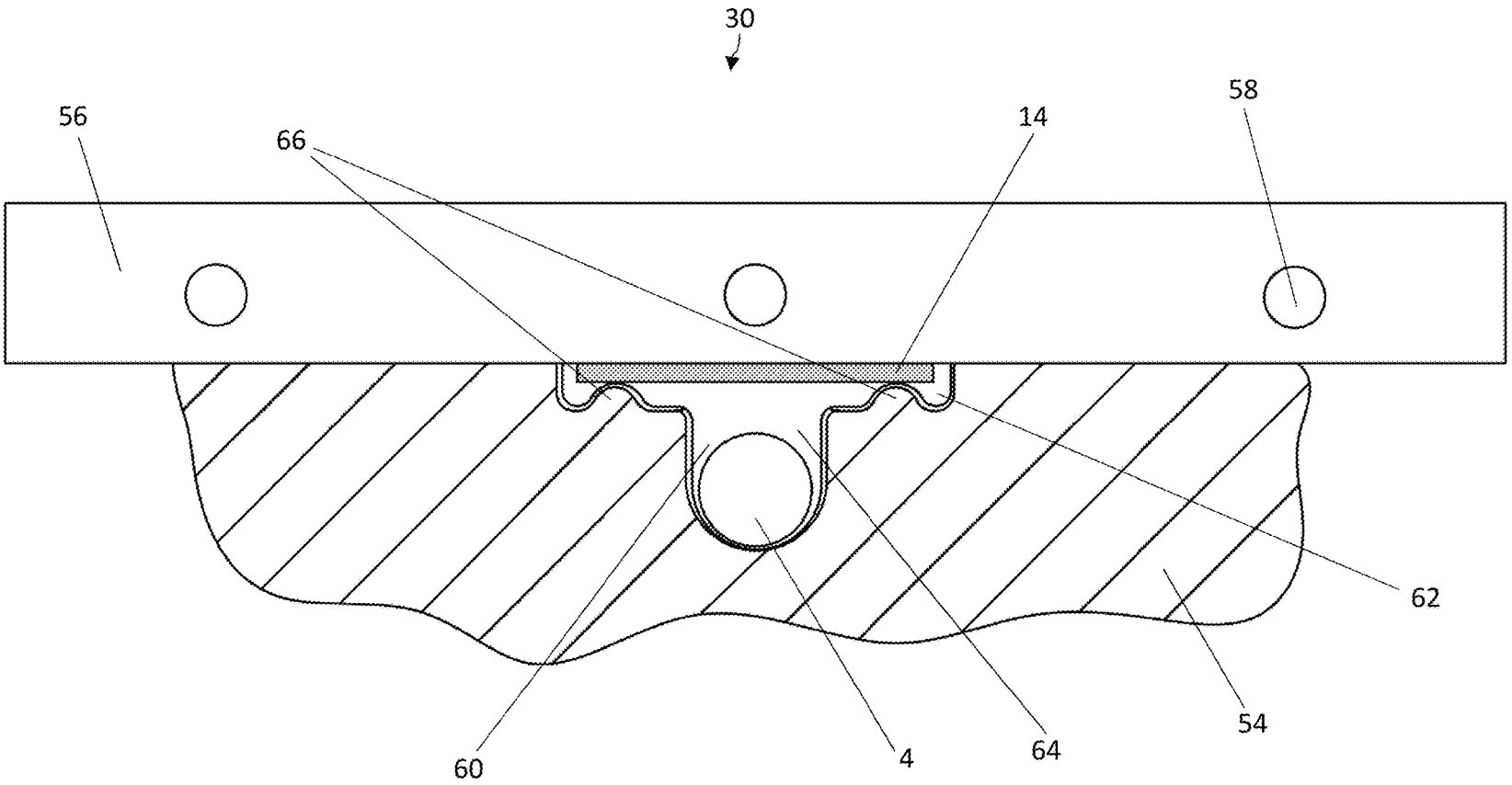
FIG. 29 is a schematic, cross-sectional view of the sealing device of FIG. 28 in a closed sealing position.

Another possible configuration of the sealing tools 54, 56 is shown in FIGS. 28 and 29. This configuration corresponds in its essential features to the embodiment of FIGS. 15 and 16. FIG. 28 corresponds to the illustration in FIG. 15, FIG. 29 to the illustration in FIG. 16. To this extent, the description of FIGS. 15 and 16 applies to the present configuration unless otherwise indicated. Elements which are the same have been provided with the same reference numbers.

As a modification of the sealing tools of FIGS. 15 and 16, the first sealing tool 54 comprises here two upright projections 66, which correspond to the shape of the knobs 50 formed in the bottom film 6 and are arranged in such a way that that, during the sealing process, the knobs 50 come to rest on the projections 66. The projections 66 serve to support the knobs 50 of the bottom film 6 during the sealing process.

Figure 30:
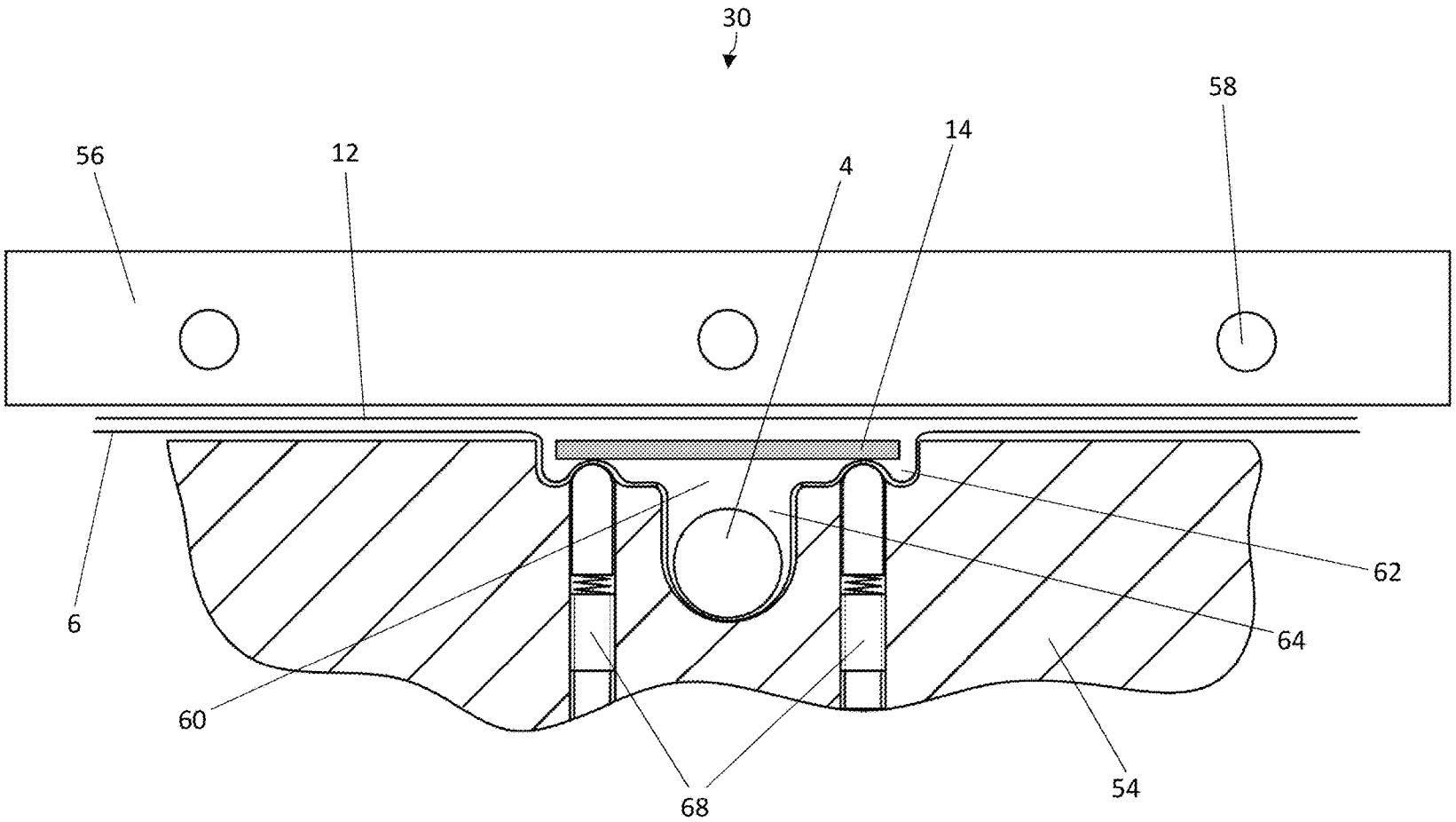
FIG. 30 is a schematic cross-sectional view of another sealing device which can be used in the method according to the disclosure for producing blister packs, in an opened position.
Figure 31:
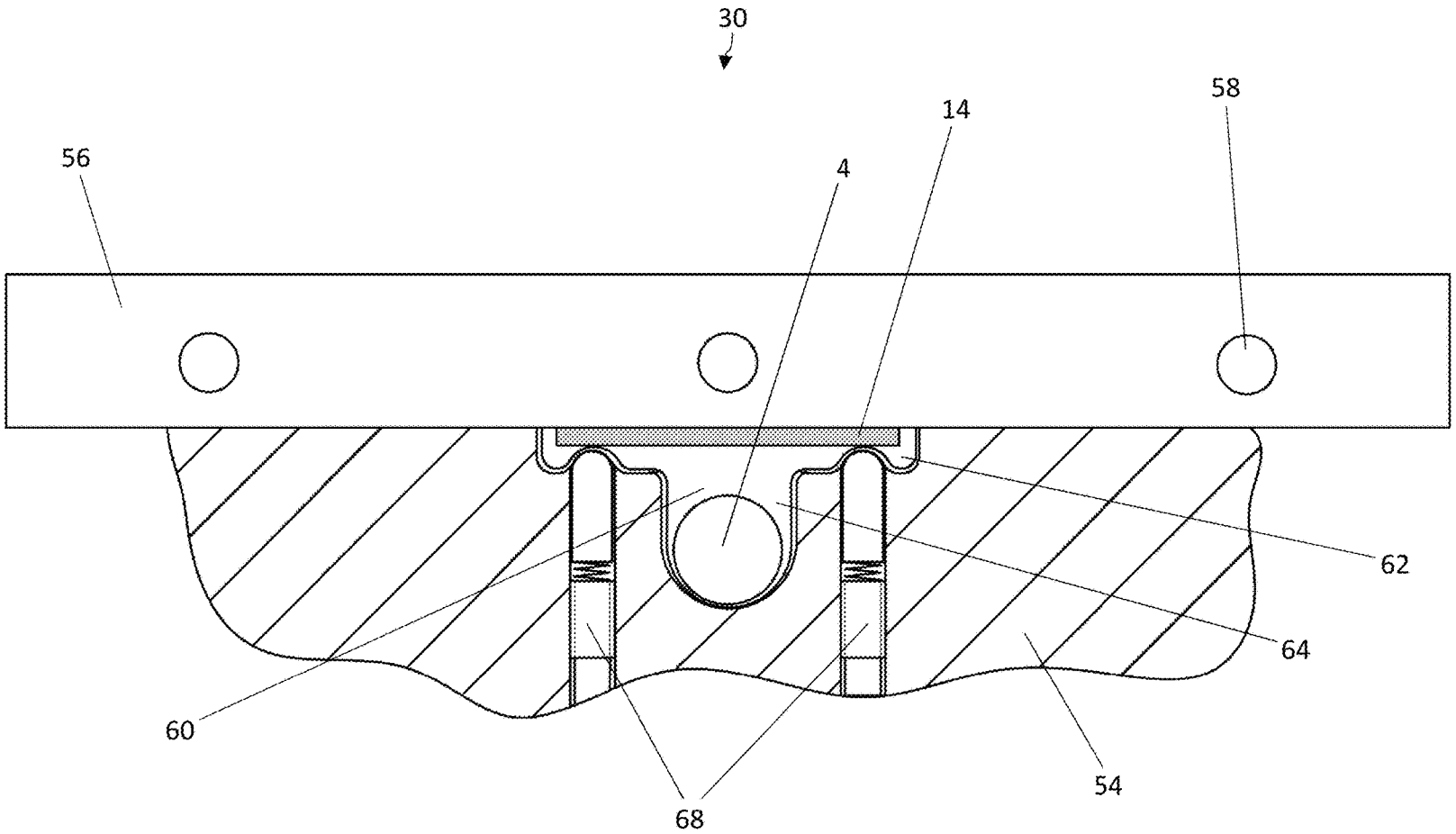
FIG. 31 is a schematic, cross-sectional view of the sealing device of FIG. 30 in a closed sealing position.

The sealing tools 54, 56 shown in FIGS. 30 and 31 correspond in their essential features to the sealing tools 54, 56 shown in FIGS. 28 and 29. Elements which are the same have been provided with the same reference numbers. As a modification of the embodiment of FIGS. 28 and 29, the projections 66 in the first sealing tool 54 are replaced by pins 68, which extend upward, beyond the bottom area of the first recess 62 of the trough 60. The pins 68 serve to support the knobs 50 of the bottom film 6 during the sealing process. The pins 68 can be spring-loaded, as shown. The pins 68 can be mounted in the first sealing tool 54 in such a way that they can be extended.

The knobs 50 in the bottom film 6 preferably comprise a height in the range of 0.5-5 mm, preferably of 1-3 mm. Accordingly, the projections 46 in the first forming tool 34 and possibly the projections 66 in the first sealing tool 54 have a height in the range of 0.5-5 mm, preferably of 1-3 mm. If pins 68 are being used, these project preferably by an amount in the range of 0.5-5 mm, preferably of 1-3 mm, above the bottom area of the first recess 62 of the trough 60 or are extended by this amount.

In the embodiments shown, the knobs 50 are illustrated as rounded elevations. Other shapes for the knobs 50 are also conceivable; for example, the knobs 50 could have a triangular cross-sectional shape with a rounded tip or with a flat plateau surface at the top, on which the strips 14 of active material rest. The knobs 50 could also be elongated objects extending along a line (straight or curved). The shape of the projections 46, 66 and/or of the tips of the pins 68 preferably corresponds in each case to the shape of the knobs 50 in the bottom film 6.

Figure 32:
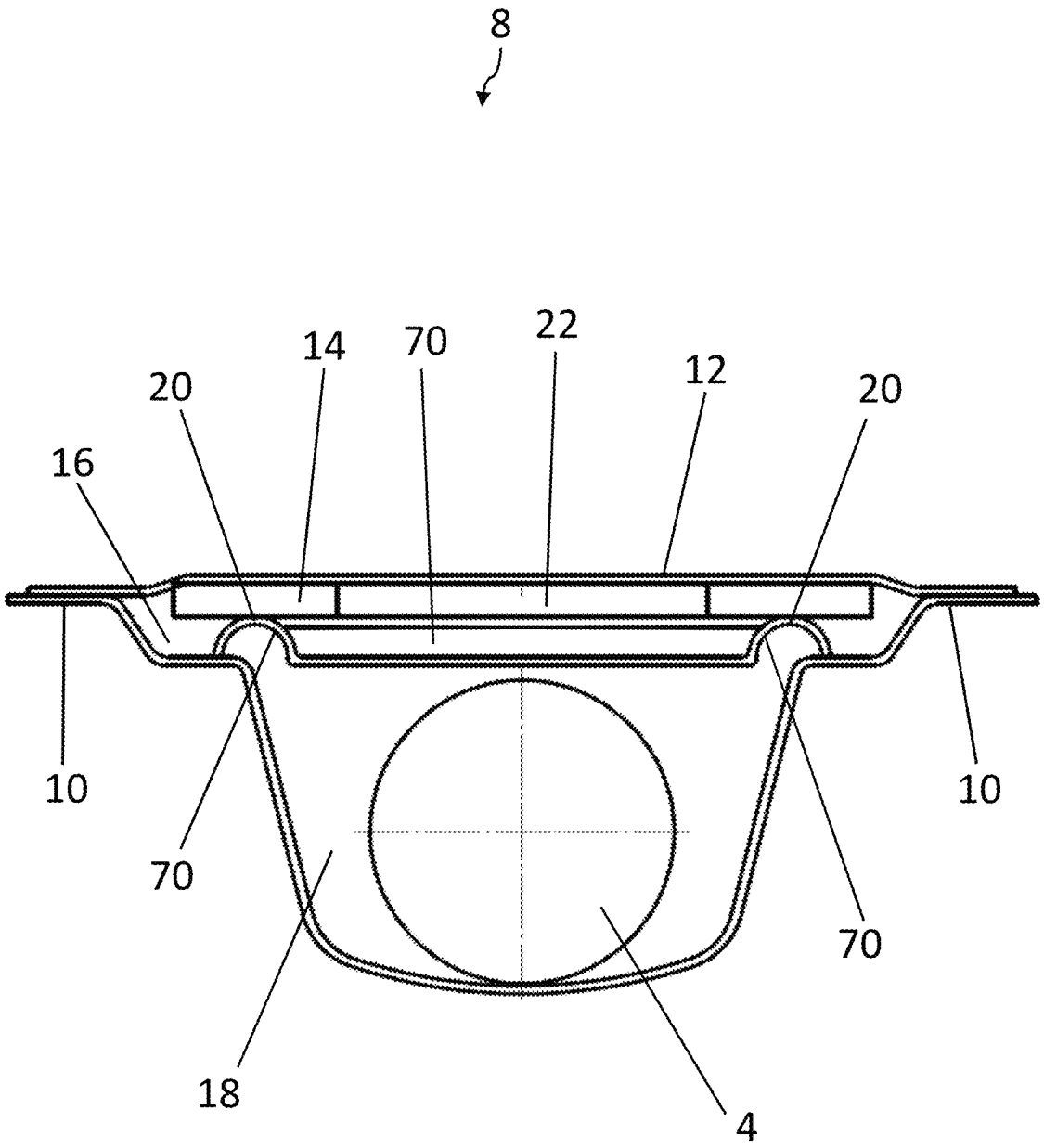
FIG. 32 is a cross-sectional view of a blister pocket of another embodiment of the blister pack according to the disclosure with a sealed-on lidding film.

It is also possible that a peripheral rib could be formed instead of several knobs 50. This is conceivable especially in the case of the embodiment according to FIGS. 8-11. FIG. 32 shows a cross-sectional view of this modification. The peripheral rib 70, when seen from above, can have any desired ring-like shape; e.g., it can appear as a circular ring, as an oval ring, a polygonal ring, etc.

Figure 33:
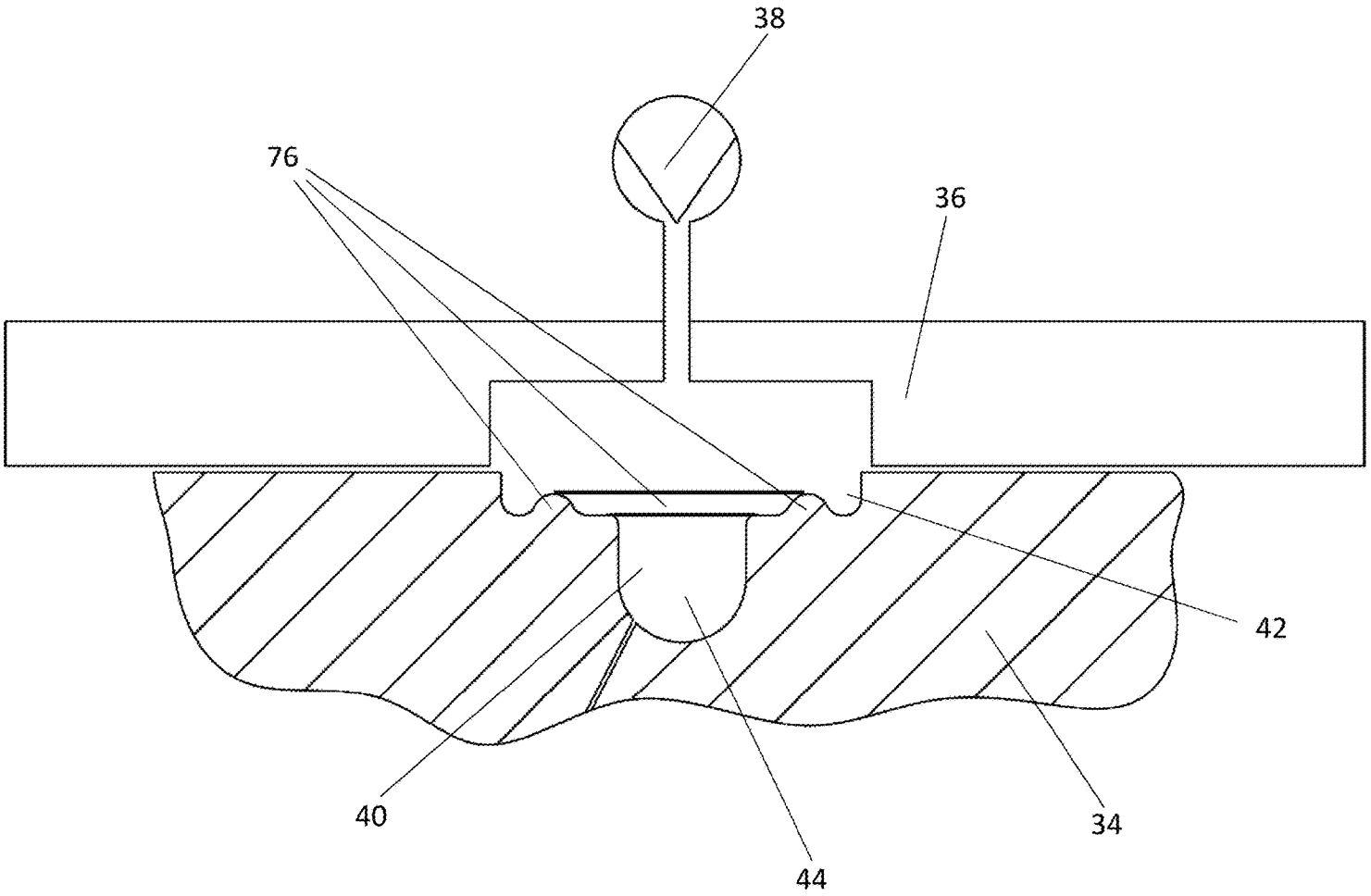
FIG. 33 is a schematic, cross-sectional view of another forming device which can be used in the method according to the disclosure for producing blister packs.

For the production of blister packs like those in FIG. 32, the only measure which must be taken with respect to the first forming tool 34 is to produce a peripheral projection 76 of the same shape as that of the rib 70. FIG. 33 shows a cross-sectional view of a configuration of this type.

Figure 34:
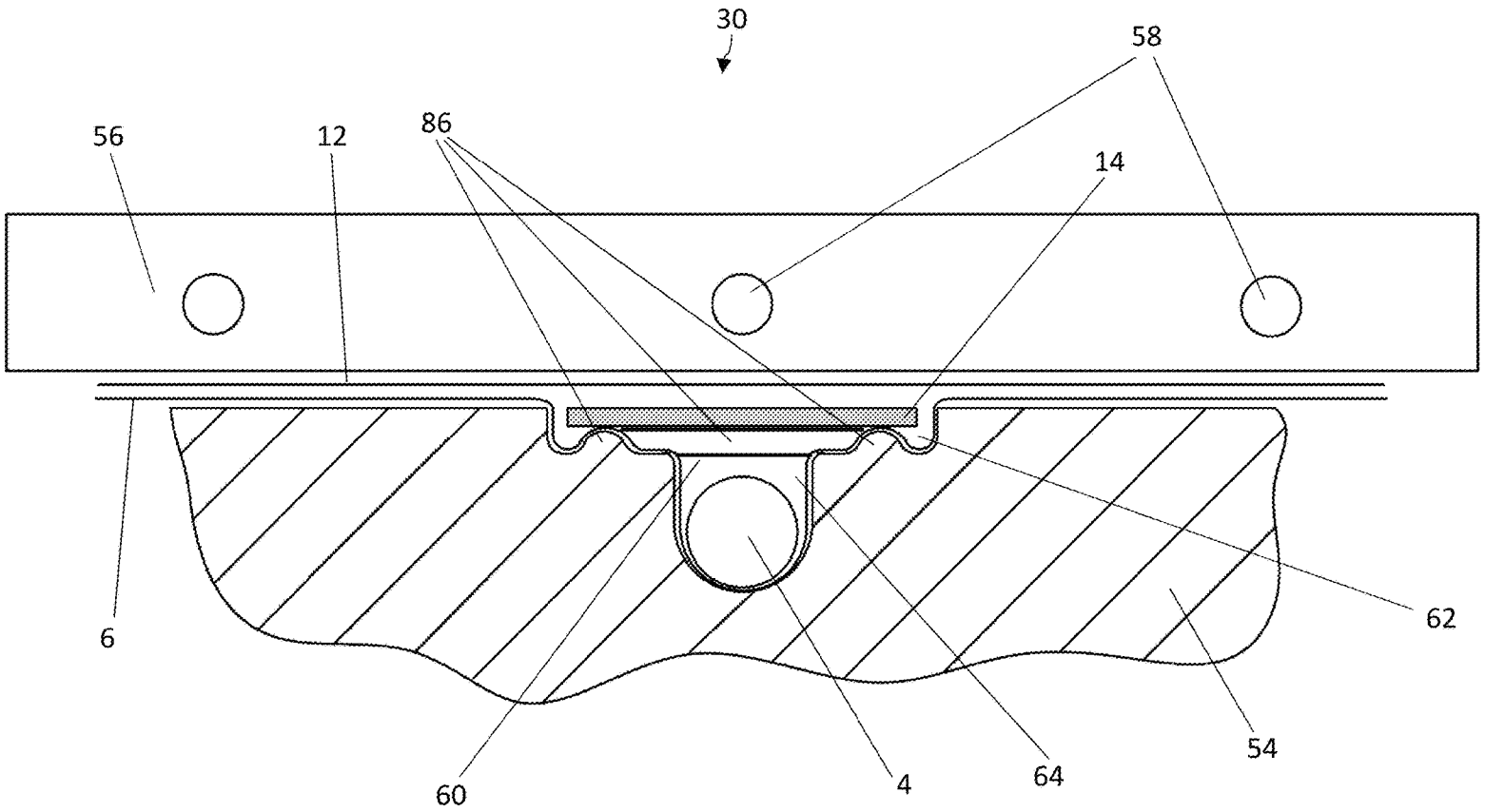
FIG. 34 is a schematic, cross-sectional view of another sealing device which can be used in the method according to the disclosure for producing blister packs, in an opened position.

With respect to the first sealing tool 54, the only measure to be taken is preferably to produce a similarly shaped peripheral projection 86, as can be seen in the cross-sectional view of FIG. 34.

Figure 35:
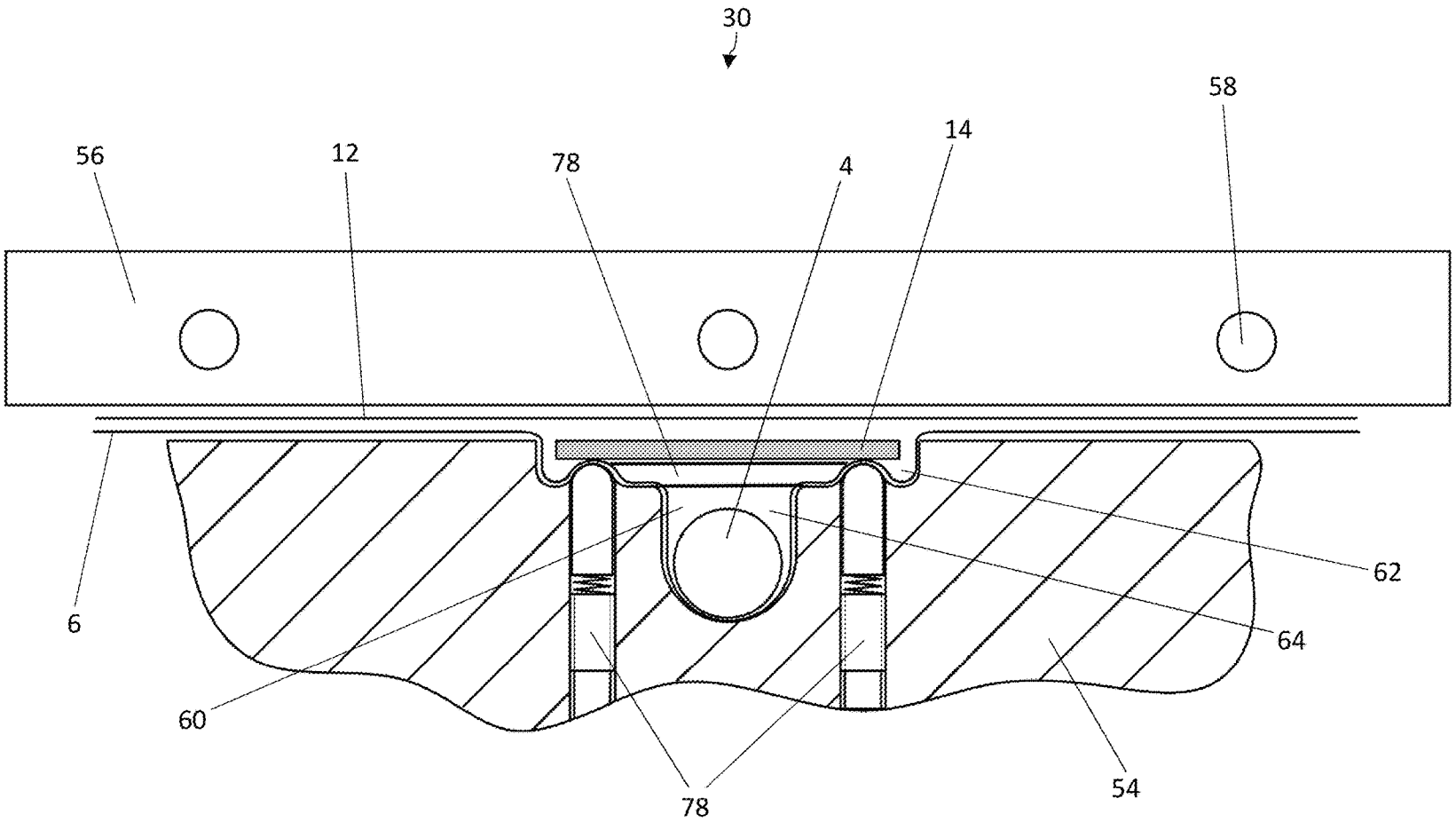
FIG. 35 is a schematic, cross-sectional view of another sealing device which can be used in the method according to the disclosure for producing blister packs, in an opened position.

Alternatively, it would be possible to use a peripheral, extendable support element 78 in the first sealing tool, the apex of which element would correspond to the shape of the rib 70. FIG. 35 shows a cross-sectional view of a configuration of this type. The support element 78 is preferably spring-loaded.

With respect to the cross-sectional shape of the rib 70, of the projection 76, of the projection 86, or of the apex of the support element 78, what was said concerning the cross-sectional shape of the knobs 50 also applies.

The invention claimed is:

1. A method for producing blister packs for medicinal products, comprising the steps of:

providing a bottom film and forming a plurality of blister pockets in the bottom film, wherein each blister pocket has an at least two-level shape with a first recess, which defines a first level of the blister pocket, and a second recess, which is formed in a subsection of a two-dimensional area over which the first recess extends and is situated lower down than the first recess;

filling the second recesses of the blister pockets with the medicinal products;

providing strips of active material and placing a strip of active material in the first recess of each blister pocket above the medicinal product, wherein the strip of active material rests on at least one support surface of the first recess, which at least one support surface is arranged next to the second recess;

providing a lidding film and sealing the lidding film to webs of the bottom film arranged around the blister pockets and simultaneously to the strips of active material, thus forming a sealed blister web; and stamping out individual blister packs from the blister web.

2. The method of claim 1, wherein providing the strips of active material is accomplished by providing a web of active material wound up into a roll and by stamping out the strips of active material from the unwound web.

3. The method of claim 1, wherein the strips of active material are sections of a film.

4. The method of claim 1, wherein the strips of active material have a thickness in the range of 0.2-2 mm.

5. The method of claim 1, wherein, as a result of its material properties, the active material has an absorption function for absorbing at least one substance or a release function for releasing at least one substance.

6. The method of claim 1, wherein placing of the strips of active material is carried out by means of a pick-and-place device.

7. The method of claim 1, wherein, after the strips of active material have been placed on the at least one support surface of the first recess, the strips of active material project above the webs of the bottom film by 0.05-0.5 mm.

8. The method of claim 1, wherein, during forming of the plurality of blister pockets in the bottom film, an upward-projecting rib extending around the second recess is, or at least two upward-projecting knobs spaced a certain distance apart are, formed in the bottom film in an area of the first recess, which rib forms, or which knobs form, the support surface or support surfaces for the strip of active material.

* * * * *